US008216427B2

(12) United States Patent
Klerelid et al.

(10) Patent No.: US 8,216,427 B2
(45) Date of Patent: Jul. 10, 2012

(54) STRUCTURING BELT, PRESS SECTION AND TISSUE PAPERMAKING MACHINE FOR MANUFACTURING A HIGH BULK CREPED TISSUE PAPER WEB AND METHOD THEREFOR

(75) Inventors: Ingvar Berndt Erik Klerelid, Karlstad (SE); Ola Thomasson, Rottneros (SE); Bo-Christer Aberg, Halmstad (SE); Cary P. Johnson, Clifton Park, NY (US); John J. LaFond, Appleton, WI (US)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 12/561,840

(22) Filed: Sep. 17, 2009

(65) Prior Publication Data

US 2010/0065234 A1 Mar. 18, 2010

Related U.S. Application Data

(63) Continuation of application No. PCT/SE2008/051332, filed on Nov. 20, 2008.

(60) Provisional application No. 61/097,837, filed on Sep. 17, 2008.

(51) Int. Cl.
*D21F 7/08* (2006.01)
*D21H 27/40* (2006.01)

(52) U.S. Cl. ..... 162/358.2; 162/116; 162/361; 162/362; 162/900

(58) Field of Classification Search ..... 162/116, 162/205–207, 358.1, 358.2, 358.4, 361, 348, 162/359.1, 360.2, 362; 34/95
See application file for complete search history.

(56) References Cited

U.S. PATENT DOCUMENTS

| | | | | |
|---|---|---|---|---|
| 5,594,997 | A * | 1/1997 | Lehtinen | 34/95 |
| 5,861,082 | A | 1/1999 | Ampulski et al. | |
| 6,340,413 | B1 * | 1/2002 | Nilsson et al. | 162/361 |
| 6,432,273 | B1 * | 8/2002 | Honkalampi et al. | 162/205 |
| 6,488,816 | B1 * | 12/2002 | Klerelid | 162/359.1 |
| 6,547,924 | B2 | 4/2003 | Klerelid et al. | |
| 6,780,282 | B2 * | 8/2004 | Scherb et al. | 162/111 |
| 6,998,017 | B2 | 2/2006 | Lindsay et al. | |
| 2008/0163998 | A1 * | 7/2008 | Crook et al. | 162/360.2 |

* cited by examiner

*Primary Examiner* — Eric Hug
(74) *Attorney, Agent, or Firm* — Frommer Lawrence & Haug LLP; Ronald R. Santucci; Vivek P. Shankam

(57) ABSTRACT

A structuring layer of a structuring belt for structuring a wet fibrous web in a press section of a tissue papermaking machine for manufacturing high bulk tissue paper, the structuring layer having a web-carrying side with a surface for cooperating with the fibrous web, the surface having depressions distributed over the web-carrying side and forming a three-dimensional structure of the surface. The depressions altogether constitute 20-80% of the surface. Each depression has a dimension l of 0.25-2.5 mm in a first direction in the plane of the top surface area, a dimension b of 0.25-2.0 mm in a second direction in the plane of the top surface area, such directions being at right angles to each other, a mean depth d of 0.05-0.6 mm, and an area a as measured in the plane of the top surface area of 0.063-5.0 $mm^2$.

31 Claims, 18 Drawing Sheets

STRUCTURING BELT, PRESS SECTION AND TISSUE PAPERMAKING MACHINE FOR MANUFACTURING A HIGH BULK CREPED TISSUE PAPER WEB AND METHOD THEREFOR

CROSS-REFERENCE TO RELATED APPLICATION

The present application is a continuation of International Patent Application PCT/SE2008/051332 filed on Nov. 20, 2008 and published under PCT Article 21(2) in the English language, and also claims the benefit of the priority date of U.S. Provisional Patent Application Ser. No. 61/097,837 filed on Sep. 17, 2008, the entire disclosures of such applications being hereby incorporated herein by reference.

BACKGROUND OF THE INVENTION

This invention relates to a structuring layer of a structuring belt used for structuring a wet fibrous web by means of pressing in a press section of a tissue papermaking machine for manufacturing high bulk tissue paper, wherein the structuring layer has a web-carrying side with a surface for cooperating with the fibrous web, said surface having depressions forming a three-dimensional structure of the surface. The invention also relates to a structuring belt for structuring a wet fibrous web in a press section by means of pressing in a tissue papermaking machine for manufacturing high bulk tissue paper. The invention further relates to a press section employing such a structuring belt, and to a tissue papermaking machine having such a press section.

The invention also relates to a method of manufacturing a structured high bulk tissue paper web and to such a high bulk tissue web.

The invention relates furthermore to a method of converting or upgrading an existing tissue papermaking machine.

The term "tissue paper" as used herein refers to soft paper with a basis weight usually of less than 25 g/m$^2$. Tissue paper web having a basis weight of 10-50 g/m$^2$ (more preferably 15-25 g/m$^2$) forms a base paper from which certain single-ply and/or multi-ply products (e.g., napkins, towels, and toilet paper) can be manufactured. The term "high bulk" tissue paper means that the bulk is about 8-20 cm$^3$/g and the single-ply tissue paper web thickness is about 160-400 μm.

Tissue paper is manufactured from a mixture of hardwood and softwood cellulose fibers, usually from a so-called "virgin" pulp constituting fresh fibers, as opposed to recycled fibers. Alternatively, recycled fibers can be mixed in with virgin fibers to make the pulp. Depending on the particular products to be made, various mixtures of fibers can be used. For example for toilet paper and/or facial tissue, the pulp may comprise 50-90% by weight of hardwood and 50-10% by weight of softwood fibers, a preferred mixture being about 70% hardwood and 30% softwood. For paper towels, the pulp may comprise 0-50% by weight hardwood and 100-50% by weight softwood fibers.

In manufacturing creped tissue paper, typically the formed wet paper web of cellulose fibers is dewatered before final drying on a Yankee cylinder, the dewatering usually being performed by either a pressing technique or a through-air-drying (TAD) technique. In some conventional tissue machines a suction pressure roll or a blind-drilled roll is used as a press roll that presses the web against the Yankee cylinder, but this compression of the web results in a final tissue product with relatively low thickness and low bulk such as 5-9 cm$^3$/g. In other conventional tissue machines the web is pressed and dewatered in a double-felted pre-press before the reaching the Yankee cylinder, the pre-press being formed by two press rolls that define a press nip therebetween, but again, the rolls compress the paper web uniformly and it results in the web having relatively low thickness and bulk. It has been proposed to use an extended-nip press such as a shoe press as an alternative to the above-mentioned conventional pressing techniques, which extended- or long-nip press can apply lower pressure but provides a longer dwell time in the nip. As another alternative, it has been proposed to use a shoe press against the Yankee cylinder in order to decrease the compression of the web in the press nip, so as to increase the bulk or thickness of the web. The objective has been to achieve the same level of bulk or thickness as achieved by the TAD technique, but up to now this has not been possible. The thickness or bulk of the paper is important for the absorption ability of the paper and the feel of softness. The TAD technique therefore is still superior to the pressing technique in terms of achieving high bulk or thickness of the paper web, but it has the disadvantage that it necessarily requires higher energy consumption than is the case with a pressing technique, especially when TAD is used as a pre-drying process on a web containing a substantial amount of water to be removed. When TAD is used in place of the Yankee cylinder for final drying of the tissue web, the TAD technique requires less drying capacity than when it is used for pre-drying, and therefore has a lower energy consumption. Therefore, using TAD for final drying could be a viable alternative to the use of a Yankee cylinder.

In tissue papermaking machines that employ the pressing technique for dewatering the paper, a press felt runs together with the tissue web through the press nip, and the press felt receives water squeezed from the web and carries the water away. In order to achieve a high bulk, it is preferred to use only one press nip, but in some cases a single nip cannot achieve sufficient dewatering and hence one has to compromise and use a second press nip.

In tissue machines employing the pressing technique, it is also possible to use a "structuring clothing", which is a clothing whose web-contacting surface has a lot of voids and top portions distributed between the voids. As the structuring clothing passes along with the tissue web through the press nip, the voids receive the fiber network of the tissue web, and therefore only those areas of the web contacted by the top portions of the clothing are compressed. Furthermore, in order to reduce compression in the nip and thereby increase the bulk or thickness of the fiber web in comparison with that obtainable using smooth roll presses, it is possible to use an extended-nip press as noted above. Such a structuring clothing can be a woven wire, belt, or fabric, including but not limited to a TAD fabric. The woven structure of such a fabric forms the voids and top portions of the web-contacting surface as described above. Such a fabric can further have a special coating (e.g., of a photo-sensitive resin or other type of material) to emphasize or form the pattern to be embossed into the wet tissue web during pressing in the press nip.

The term "structuring" of the paper as used herein refers to a process in which a three-dimensional pattern of the structuring layer of a structuring belt is embossed into the wet fibrous web during a pressing process when the fibrous network structure fills the three-dimensional (3D) pattern of the structuring belt layer, and in which fibers in the wet fibrous web are still movable relative to each other so that they are advantageously brought to new positions and directions relative to each other by the action of the elastically compressible press felt, which presses the wet fibrous web into the three-dimensional pattern or voids of the structuring belt layer, thereby promoting fiber binding between the fibers of the network and achieving partial dewatering of the wet fibrous web while achieving an increased bulk at the same basis weight, and MD and CD tensile strengths of the finally dried tissue paper web comparable to those of conventional tissue paper, and achieving an improved structure of this basic tissue paper.

U.S. Pat. Nos. 6,547,924 and 6,340,413 describe a tissue papermaking machine in which a structuring belt carries the fibrous web from the last press in the press section to the drying cylinder. However, the papermaking machine described in these references cannot produce a tissue paper of sufficiently high quality and high bulk while also achieving an acceptable dryness to make this machine concept commercially attractive/interesting. The described machines, because of the plurality of press nips required in order to meet the requirements for the dryness of the web for its runnability, do not meet the wishes of customers today to have a high bulk paper. Furthermore, there were problems with runnability of the machine, as either the web was too wet because the press felt was saturated with water and could not absorb a sufficient quantity in the nip, which led to paper breaks, or the dryness was sufficient and the runnability was good but the bulk or the quality of the final tissue paper web was too low. Additionally, the impermeable structuring belt described in these patents has a polymer web-contacting layer that includes grooves, but the dimensions of the grooves are such that the desired hydraulic pressure into the grooves cannot be created, which results in runnability problems, particularly web breaks as noted.

BRIEF SUMMARY OF THE INVENTION

The present invention relates to the structuring of a wet web by a 3D structuring layer of a structuring belt, and to a structuring belt comprising such a structuring layer for use in pressing technology for manufacturing a high bulk tissue paper. The structuring belt itself is a non-woven or woven clothing. This means that 3D patterns of the structuring layer are created not by a woven structure, but by other means. The bulk of the paper is maintained in that depressions defined solely within the thickness of the structuring layer (i.e., not defined by the structure of any underlying layer beneath the structuring layer) of the belt receive the fibrous network of the wet tissue web thereon and those depressions prevent compaction of the entire web structure during the pressing.

Following comprehensive research, the present inventors have realized that the structure of the structuring layer that is in contact with the web during the pressing process has great and probably crucial importance from the point of view of being able to achieve a tissue paper with a higher bulk than that previously possible in a conventional papermaking machine using the conventional pressing technique with the multiple presses or with a press roll against a Yankee cylinder, and that the structure of this layer of the structuring belt can also be used as a parameter for controlling properties of the web after the nip and for achieving a high dryness of the web in the press section in which the actual structuring of the wet fibrous web occurs.

An object of at least some embodiments of the invention is to make it possible to manufacture, at a low energy cost, a tissue paper web of high bulk comparable to that of TAD-paper, and in particular having a bulk of about 12-20 $cm^3/g$ depending on the chosen basis weight of the web, as compared to a conventional tissue paper typically having a bulk of only 6-9 $cm^3/g$ for the same basis weight. Reduction of the energy cost and energy saving are achieved by attaining a relatively high dryness (about 40-52%) directly after the first, and preferably the only, press nip, which makes it possible to avoid having to use the TAD technique as a pre-drying process in order to increase the dryness of the fiber web prior to entering the press nip for ensuring the machine runnability and avoiding the web breaks in the press nip and prior to the final drying of the tissue web. Thus the required drying capacity (including but not limited to a size of the drying cylinder and its temperature, a hood with integrated fans, air supply and so on) of the machine is reduced by 20-35%. Energy savings in the final drying section of the machine could be up to about 35%.

High bulk of a tissue paper web is an important property for the absorption capacity of the web. The single-layered paper web can then be rewound into single-layered or multi-layered finished consumer products such as sanitary paper, napkins, towels, facial tissue and toilet paper. The quality of these products is determined at least in part by their absorption capacity and their soft feel to the consumer.

In accordance with some embodiments of the invention, a structuring belt is employed having a structuring layer that defines a web-contacting surface for cooperating with and structuring of the wet fibrous web in the pressing process. The web-contacting surface of the structuring layer has voids or depressions, or alternatively elevations, forming a three-dimensional structure of the web-contacting surface, the depressions or elevations being distributed over the web-contacting surface and together constituting 20-80% of the web-contacting surface. The web-contacting surface also includes a continuous flat top surface area between the depressions or voids, or alternatively includes a flat valley surface area between the elevations, the top surface area or valley surface area delimiting the depressions or elevations, respectively. Each depression or elevation has a dimension l in a first direction (x) in the plane of the top surface area, a dimension b in a second direction (y) in the plane of the top surface area, the first and second directions (x, y) being at right angles to each other, a mean depth or mean height d (in the z-direction, which is perpendicular to the x, y-directions and extends in the thickness direction of the structured layer), and an area a as measured in the plane of the top surface area, these dimensions being defined when the belt is in a compressed state in a press nip.

BRIEF DESCRIPTION OF THE DRAWINGS

The invention is described further with reference to the drawings, in which.

DETAILED DESCRIPTION OF THE DRAWINGS

Figure 7:
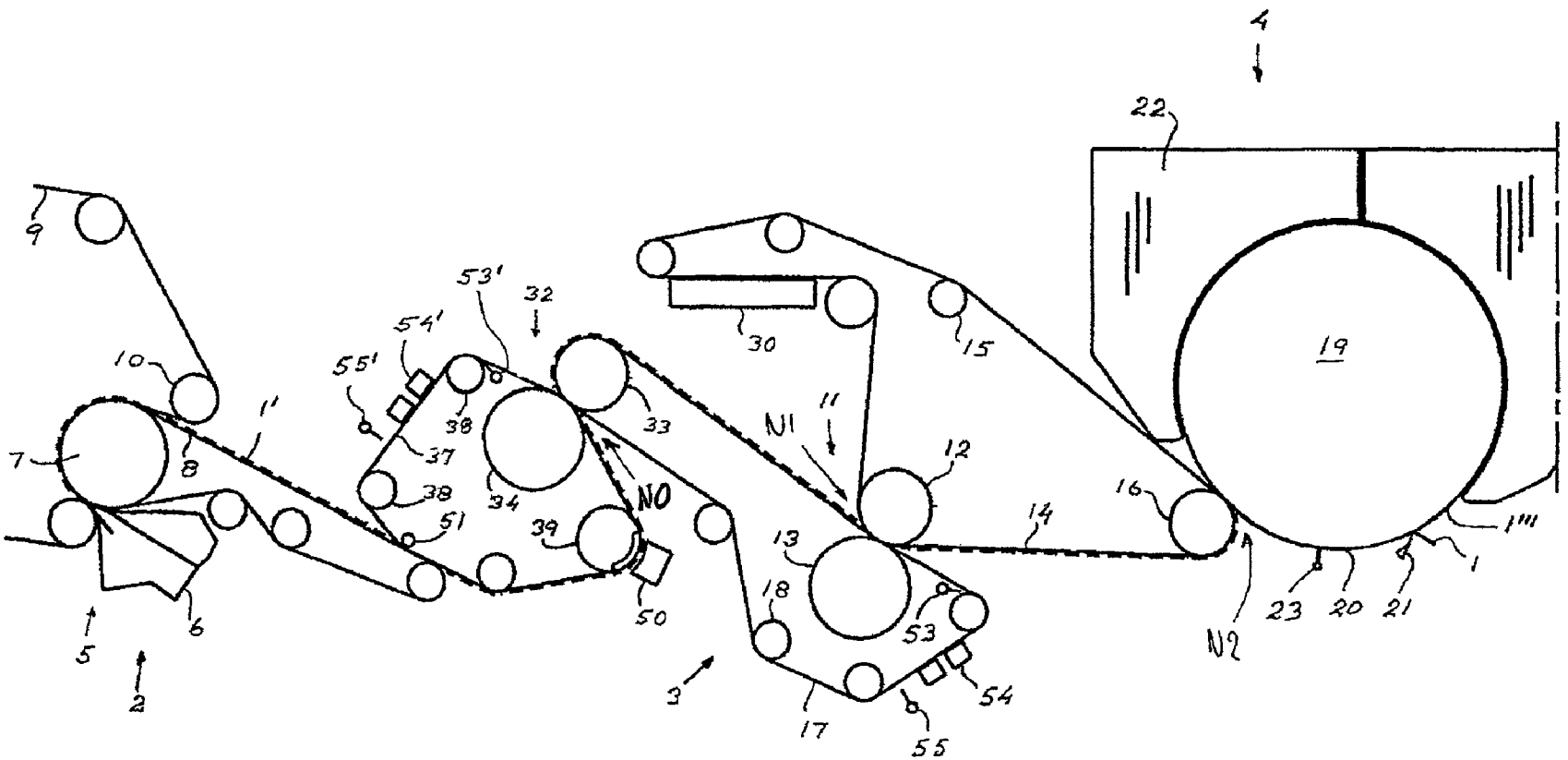
Figure 8:
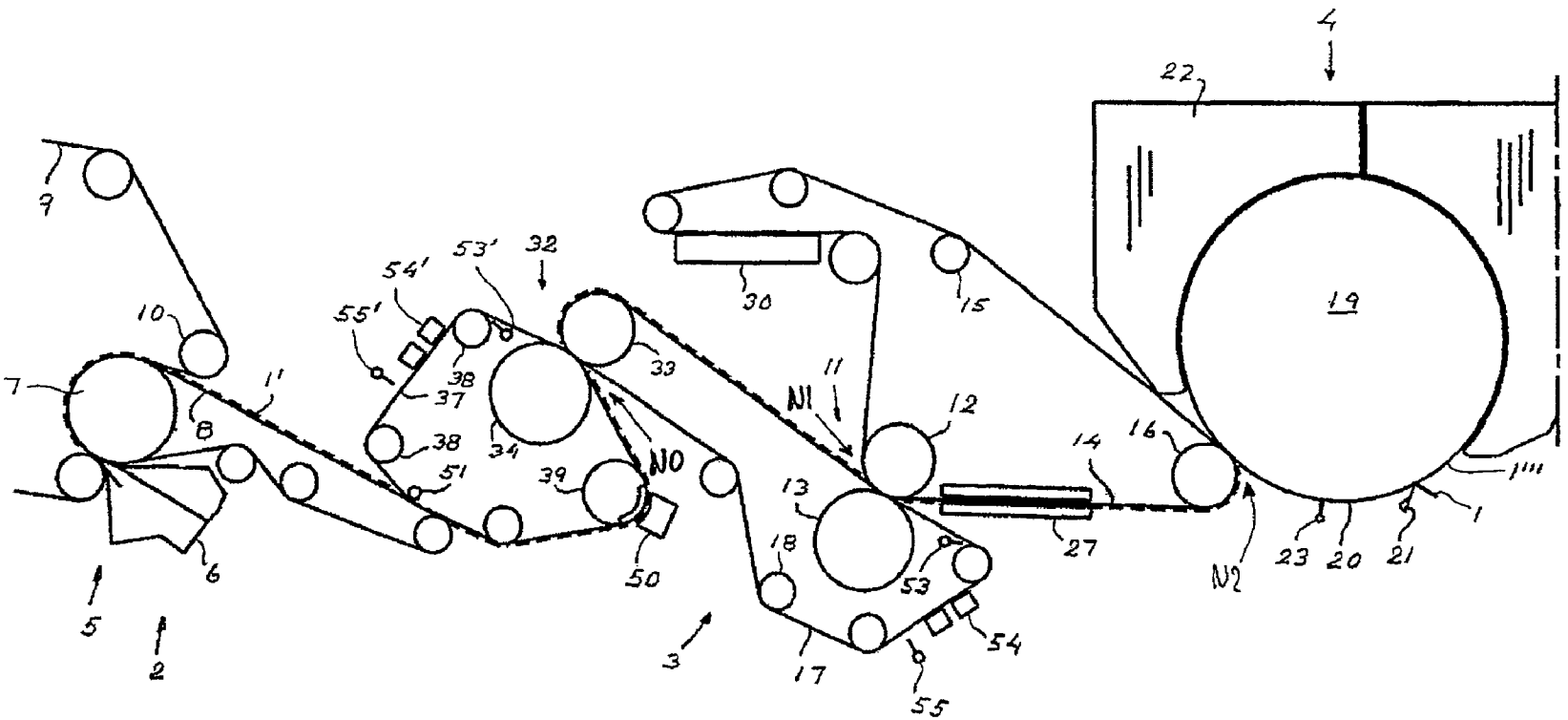
Figure 9:
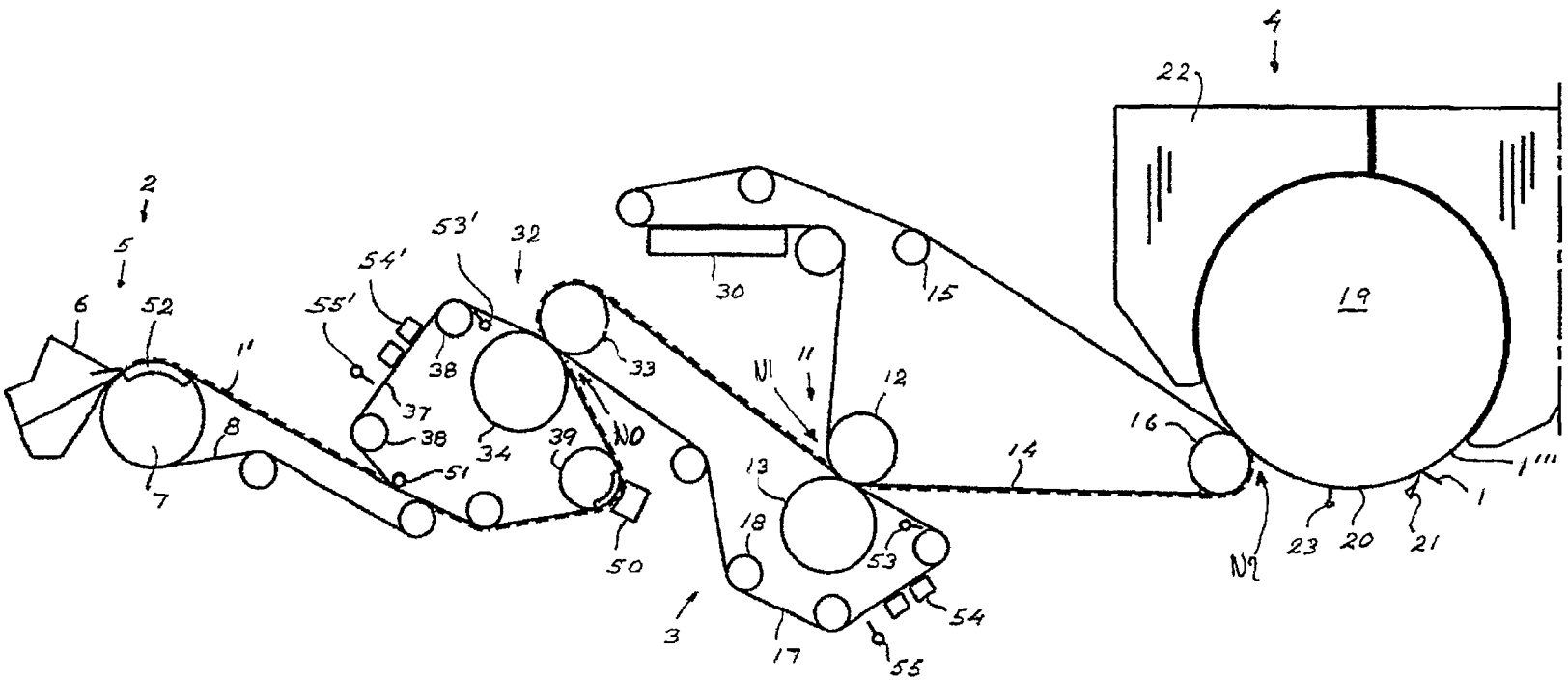
Figure 10:
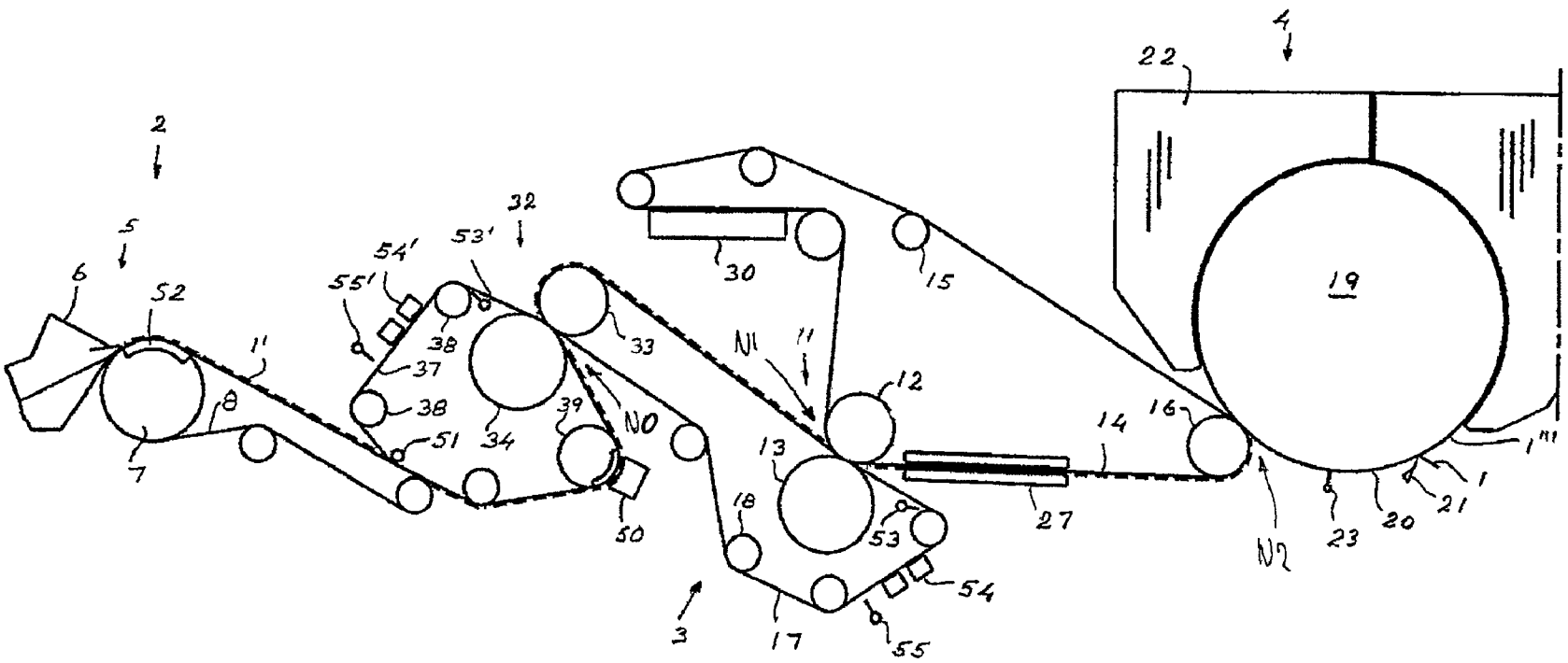
Figure 11:
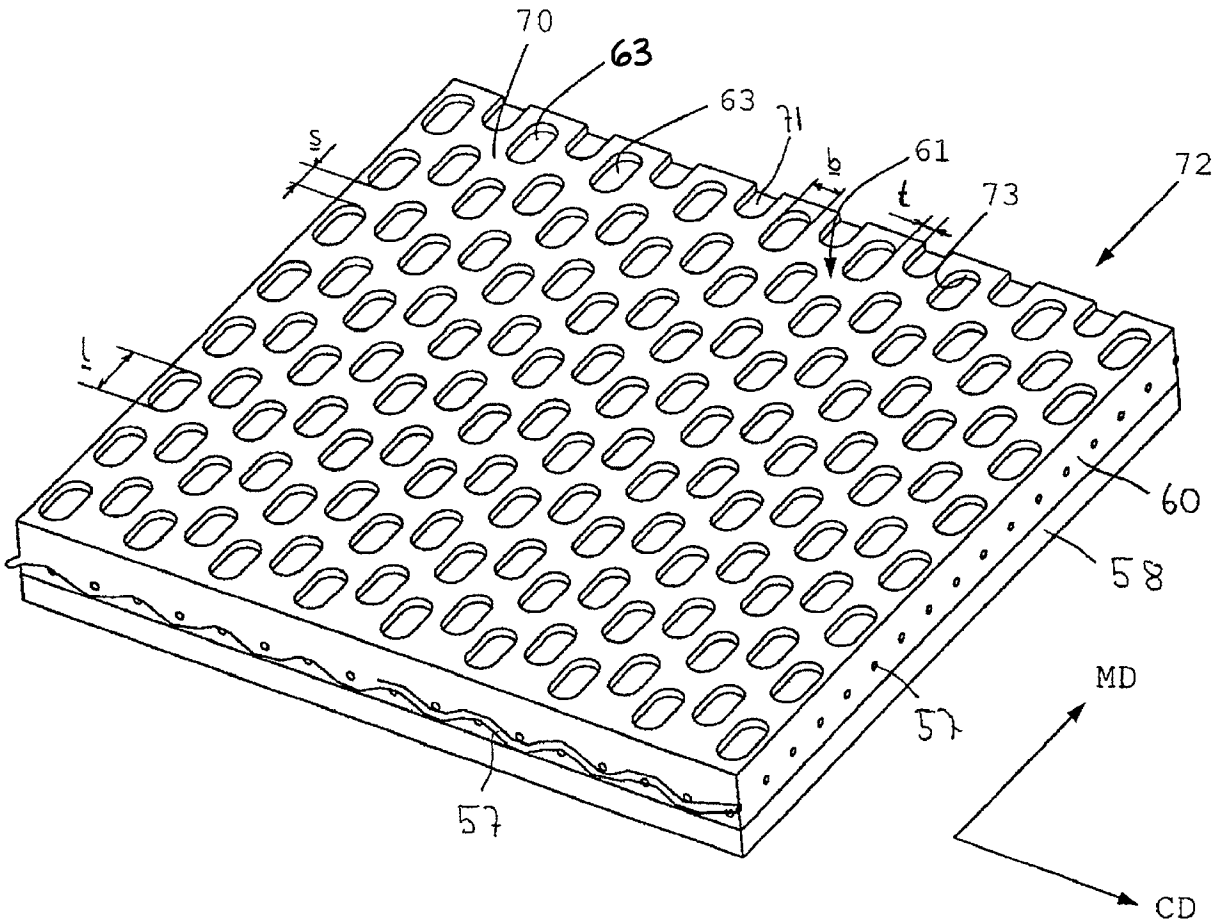
FIGS. 11 and 12 show a section of a structuring layer of structuring belt according to a first embodiment of the invention.

FIGS. 1-10 schematically depict various embodiments of a tissue papermaking machine according to the present invention for manufacturing a tissue paper web 1 in which the web is structured by means of pressing, without the use of through air drying (so-called TAD) as a pre-drying process. All of the embodiments comprise a wet section 2 for forming a continuous embryonic cellulosic fiber web 1', a press section 3 for pressing and structuring the wet fiber web to achieve a structured fiber web 1", and a drying section 4 for final drying of the fiber web 1" and achieving a finally dried base tissue paper web 1'". The wet section 2 of each tissue papermaking machine according to the illustrated embodiments comprises a forming section 5. In the embodiments according to FIGS. 1-8, the forming section 5 is a so-called double-wire forming section having a first forming clothing 8 and a second forming clothing 9. In particular, FIGS. 1, 2, 7, and 8 illustrate a so-called C-former, and FIGS. 3-6 illustrate a so-called Crescent former. In both of these double-wire formers, the first forming clothing 8 runs in an endless loop about and in contact with a forming roll 7 (i.e., a so-called breast roll), and the second forming clothing 9 runs in an endless loop about a plurality of support rolls 10 and about the forming roll 7 in contact with the first clothing 8. A headbox 6 is arranged for feeding a stock of cellulose fibers mixed with water between the first clothing 8 and the second clothing 9, after which the stock is dewatered through the clothing 9 such that an embryonic wet cellulosic fibrous web 1' is formed, the web 1' then being carried by the first forming clothing 8 to the next process step. In the embodiments of FIGS. 9-11, the forming section 5 is a single-wire forming section of the so-called suction breast roll type, having only a single forming clothing 8 running about the forming (breast) roll 7. These various embodiments of FIGS. 1-11 are further described below.

The press section 3 comprises a main press 11 including a first press element 12 and a second press element 13 that cooperate with each other to form a press nip between them. The main press 11 may be a roll press, a long-nip or extended-nip press such as a shoe press (not shown in the figures), or any other type of extended-nip press known in the art. The press section 3 further comprises a structuring belt 14 with a structuring layer 60 according to the present invention running in an endless loop about a plurality of supporting rolls 15, about a smooth transfer roll 16 located in connection to the drying section 4, and through the press nip N1 of the main press 11 together and in contact with the formed fibrous web 1' in order to provide pressing, dewatering, and structuring of the formed embryonic fibrous web 1' when it passes through the press nip N1 so that a structured or embossed, partially dewatered fibrous web 1" exits the press nip N1. The structured fibrous web 1" is then carried by the structuring belt 14 up to a transfer nip N2 formed between the transfer roll 16 and a drying surface 20 of a drying cylinder 19. No pressing or dewatering takes place in the nip N2, but only the transfer of the partially dewatered, structured fibrous web 1" to the surface 20 of the drying cylinder 19. In this case as illustrated, the drying cylinder 19 is a Yankee cylinder, but other types of drying sections known in the art are possible, such as a TAD-cylinder for final drying. The press section 3 further comprises a water-receiving press felt 17 that is elastically formable and compressible in the z-direction (perpendicular to the plane of the felt), running in an endless loop about a plurality of support rolls 18 and through the press nip N1 of the main press 11 together with the structuring belt 14 such that the formed fibrous web 1' is sandwiched between the structuring belt 14 and the press felt 17. The first press element 12 is located in the loop of the structuring belt 14 and the second press element 13 is located in the loop of the press felt 17. In the embodiments shown in FIGS. 1-10, both press elements 12, 13 are press rolls, but alternatively they could be elements forming an extended nip. The press felt 17 diverges from the structured fibrous web 1" immediately after it has passed through the press nip N1 in order to prevent rewetting of the fibrous web 1".

Immediately before the first roll 18 after the main press 11, a spray device 53 for cleaning the press felt 17 is arranged on the inside of the press felt 17 for supplying fresh or clarified white water to the wedge-shaped narrowing space between the press felt 17 and the roll 18, the water being pressed into the press felt 17 and displacing the contaminated water in the press felt 17 after pressing in the main press 11 through and out of the press felt 17 when this runs about the roll 18. Upstream of the following roll 18, suction boxes 54 are arranged on the outside of the press felt in order to withdraw and remove water from the press felt 17. Alternatively, other suction devices known in the art could be used in this position.

Once the structuring belt 14 has left the transfer roll 16 and before it reaches the main press 11, the structuring belt 14 passes through a cleaning station 30 at which the web-contacting surface of the structuring layer 60 is cleaned from contaminations.

The drying section 4 comprises a first drying cylinder 19 having a drying surface 20, which, in the illustrated embodiments, is the only drying cylinder, and advantageously is a Yankee cylinder. Alternatively, the drying section may consist of a plurality of drying cylinders, a metal belt dryer, or a TAD-cylinder with a TAD-fabric wrapped thereabout. The particular type of final drying device used is not critical to the present invention. As noted, in the illustrated embodiments the drying surface 20 of the drying cylinder 19 cooperates with the transfer roll 16 to form the transfer nip N2, and also serves to perform final drying of the partially dewatered, structured fibrous web 1". A creping doctor 21 is arranged at a downstream point along the drying surface 20 to crepe or remove the dried fibrous web 1" from the drying surface 20 in order to obtain a tissue paper web 1'" that is both structured and creped. The drying cylinder 19 is covered by a hood 21. The structuring belt 14 and the structured fibrous web 1" run into the transfer nip N2 together but leave the transfer nip N2 separately because the structured fibrous web 1" adheres to and is transferred to the drying surface 20 of the drying cylinder 19, while the structuring belt 14 diverges from the drying surface 20 after the transfer nip N2. The pressure in the transfer nip N2 is less than 1 MPa, and could be much lower (e.g., 10 kN/m) in order to ensure that no additional compression and dewatering of the web occurs as the web passes through the transfer nip N2. In order to ensure that the fibrous web 1" is transferred and affixed to the drying surface 20, an adhesive is advantageously applied to the drying surface 20 by means of a spray device 23 at a point between the creping doctor 21 and the transfer nip N2 where the drying surface 20 is free, or by other means known in the art.

The main press 11 may be a roll press in which the two press elements 12, 13 are rolls with smooth solid mantle surfaces, or may be an extended-nip press (e.g., a shoe press) in which the first press element 12 is a smooth counter roll and the second press element 13 comprises a press shoe and an endless belt or a jacket running through the press nip of the shoe press in sliding contact with the press shoe, which exerts a predetermined pressure on the inside of the belt and on the counter roll 12. The press shoe thus constitutes a device forming an extended press nip. In a further preferred embodiment of the main press 11, the first press element 12 is a smooth counter roll and the second press element comprises a device for forming an extended press nip, said device including an elastically deformable and pressurized supporting element arranged to press in the direction towards the opposing counter roll and to generally conform its shape to a portion of the counter roll as disclosed in U.S. Pat. No. 7,527,708, which is hereby incorporated herein by reference. As an alternative to these types of extended-nip press devices, another other known type of extended-nip press could be employed.

Figure 1:
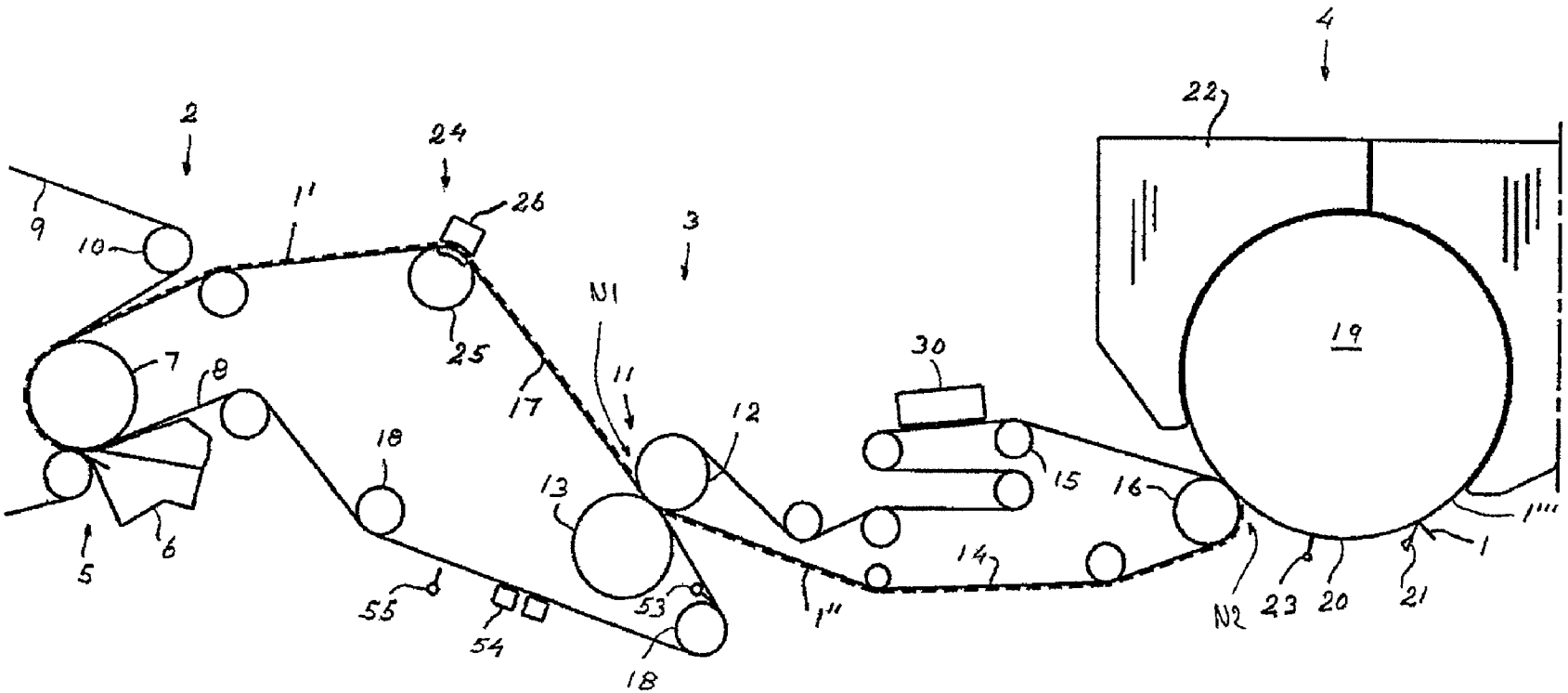
FIGS. 1 to 10 show ten different tissue papermaking machines with a structuring belt according to embodiments of the invention.

In the embodiment according to FIG. 1, the press felt 17 of the main press also serves as the first inner forming clothing 8 of the forming section 5 so that the forming roll 7 is also located within the loop of the press felt 17. The wet section 2 in this case also comprises a predewatering device 24, namely a suction device. In this particular embodiment, the suction device 24 comprises a suction roll 25 located within the loop of the press felt 17, and a steam box 26 located on the outside of the loop of the press felt 17 in front of or opposite to the suction roll 25 for heating the water into the fibrous network of the formed fibrous web 1'. The steam box 26 in this particular case has a capacity of about 0.1-0.8 ton of steam per ton of paper. The quantity of water in the fibrous structure of the formed fibrous web 1' and in the press felt 17 is decreased with the aid of the suction roll 25 and steam box 26 from about 8-12% to 15-30%, so as to give the formed fibrous web 1' a desired increased dryness preferably of about 20-30% before entering the main press 11. A high-pressure spray device 55, such as a needle-type spray device with a water jet having a diameter of 1 mm, is arranged on the outside of the forming clothing 8 upstream of the forming roll 7 in order to clean the forming clothing 8 before it reaches the forming roll 7.

Figure 2:
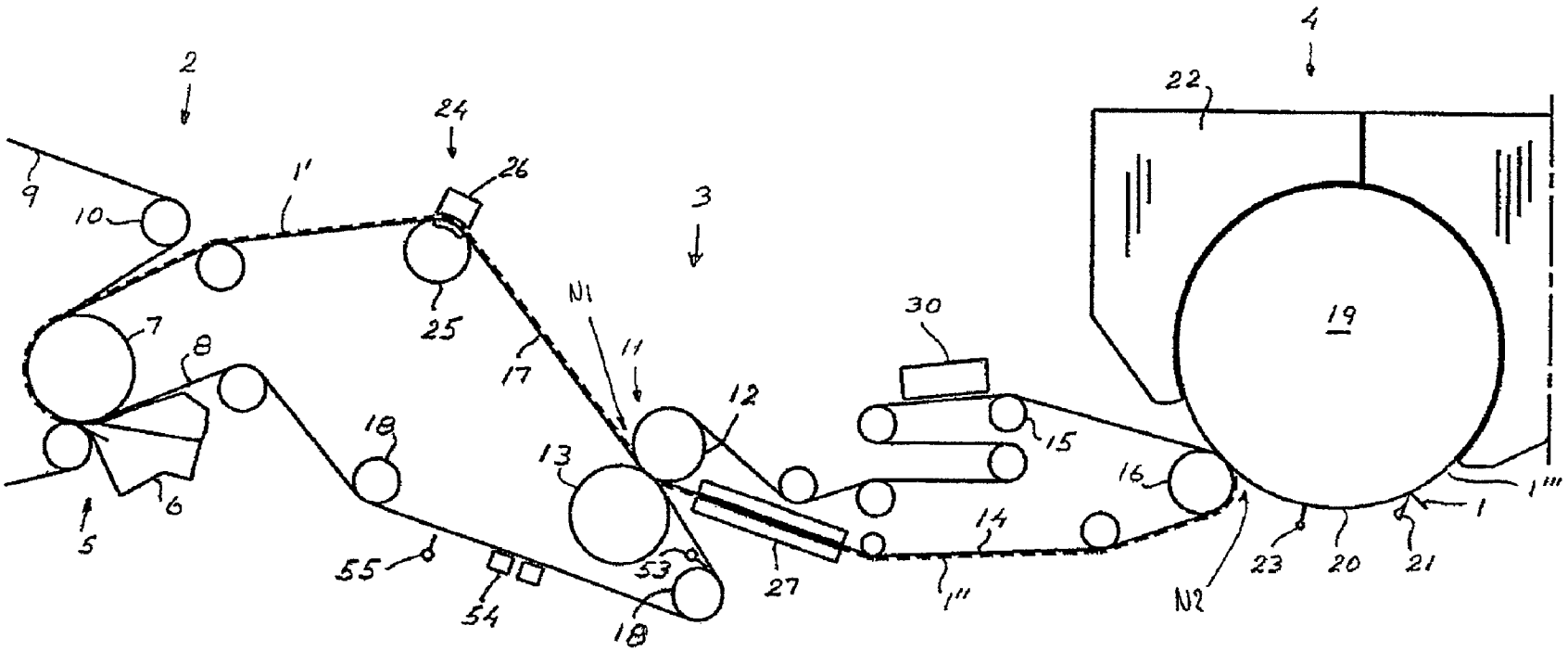

The embodiment according to FIG. 2 is similar to that of FIG. 1, except that it further includes a preheating device 27 downstream of the main press 11 in order to increase the temperature of the structured fibrous web 1" in the press 11 before the fibrous web 1" reaches the drying cylinder 19.

Figure 3:
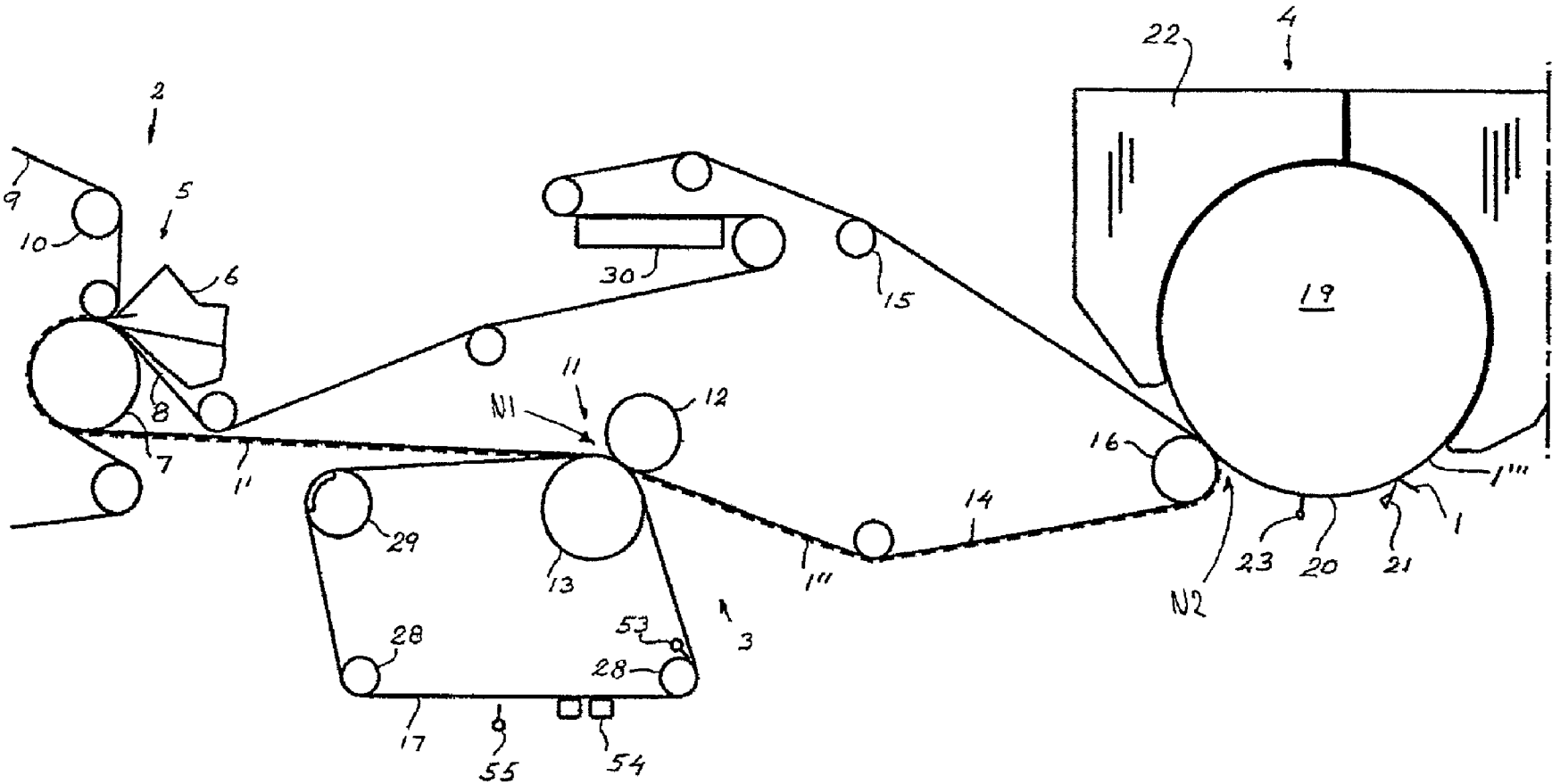

In the embodiment according to FIG. 3, the structuring belt 14 having the structuring layer 60 also serves as the first inner forming clothing 8 of the forming section so that the forming roll 7 is also located within and surrounded by the loop of the structuring belt 14. In this case, the press felt 17 of the main press 11 runs in a single loop about a plurality of supporting rolls 28 and the second press element 13. The supporting roll located upstream of the second press element 13 is a suction roll 29 by means of which water is removed from the press felt 17 in order to increase the absorption capacity of the press felt 17 to dispose of relatively large quantities of water pressed out in the nip N1. One special effect with this embodiment, in which the structuring belt 14 also passes about the forming roll 7, is that it will be possible for the cellulosic fibers of the stock to penetrate into and orient themselves in the z-direction in the depressions or voids of the structuring layer 60 of the structuring belt 14 so that some of the fibers of the formed embryonic fibrous web 1' are already oriented into the depressions before pressing is started in the main press 11. Such a pre-orientation of fibers in the depressions is therefore advantageous in order to attain a higher bulk. Immediately in front of the first roll 28 after the main press 11, a spray device 53 is arranged on the inside of the press felt 17 for supplying clarified white water into the wedge-shaped tapering space between the press felt 17 and the roll 28, said water being pressed into the press felt 17 and displacing the contaminated water in the press felt 17 after pressing in the main press 11 through and out of the press felt 17 when this runs about the support roll 28. Upstream of the following roll 28, suction boxes 54 (or similar devices) are arranged on the outside of the press felt 17 in order to withdraw and remove water from the press felt 17, and a high-pressure water spray device 55 is arranged to clear the press felt 17 before it arrives at the suction roll 29, which deals with the remaining water in the press felt 17. The suction roll 29 removes water from the press felt 17 and thus increases the capacity of the press felt to absorb the water squeezed in the nip N1 and carry it away.

Figure 4:
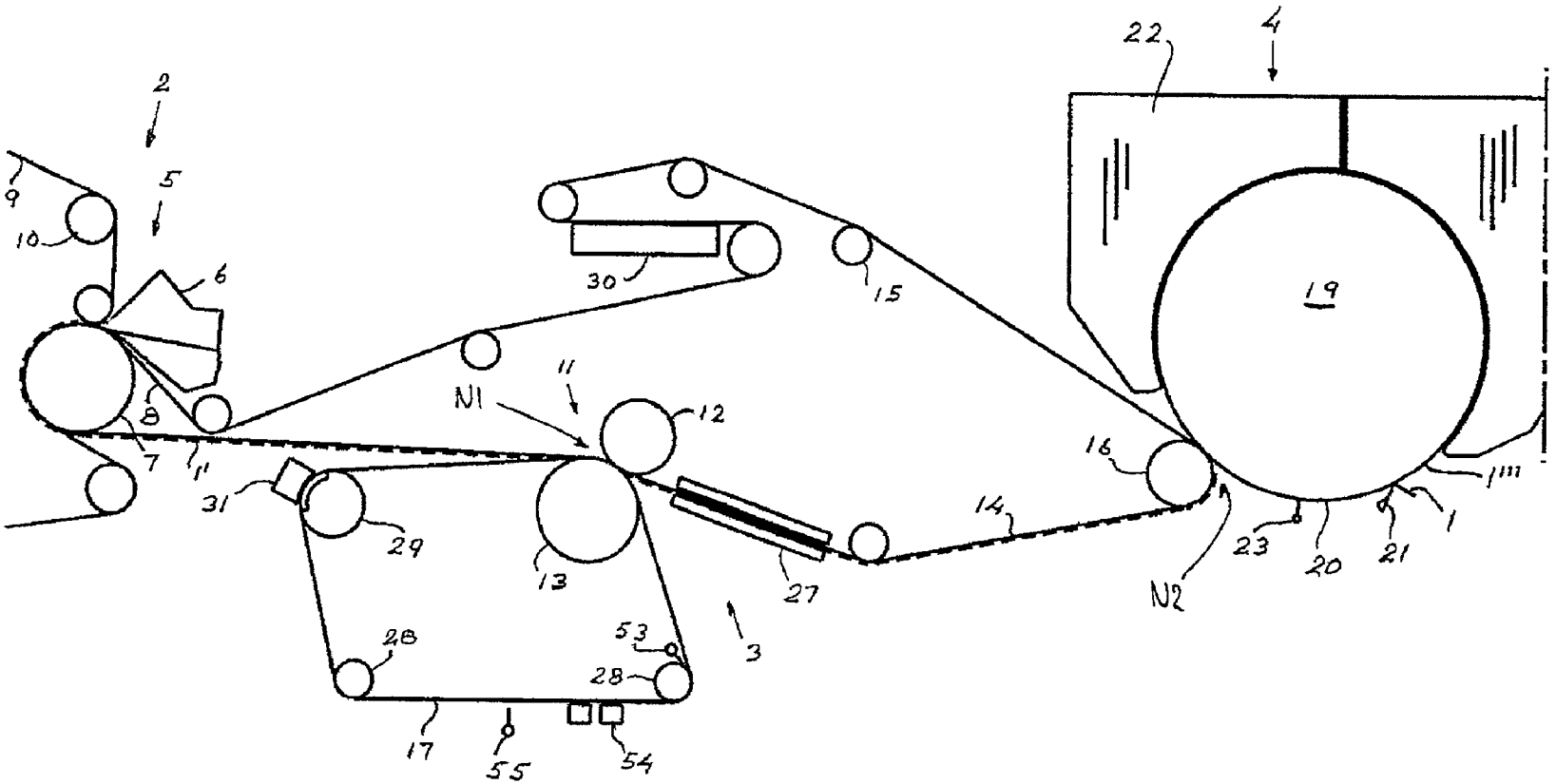

The embodiment according to FIG. 4 is similar to that of FIG. 3, except that it further includes a preheating device 27 corresponding to the embodiment of FIG. 2, and a steam box 31 is arranged on the outside of the press felt 17 immediately in front of the suction roll 29 in order to increase the dewatering capacity thereof.

Figure 5:
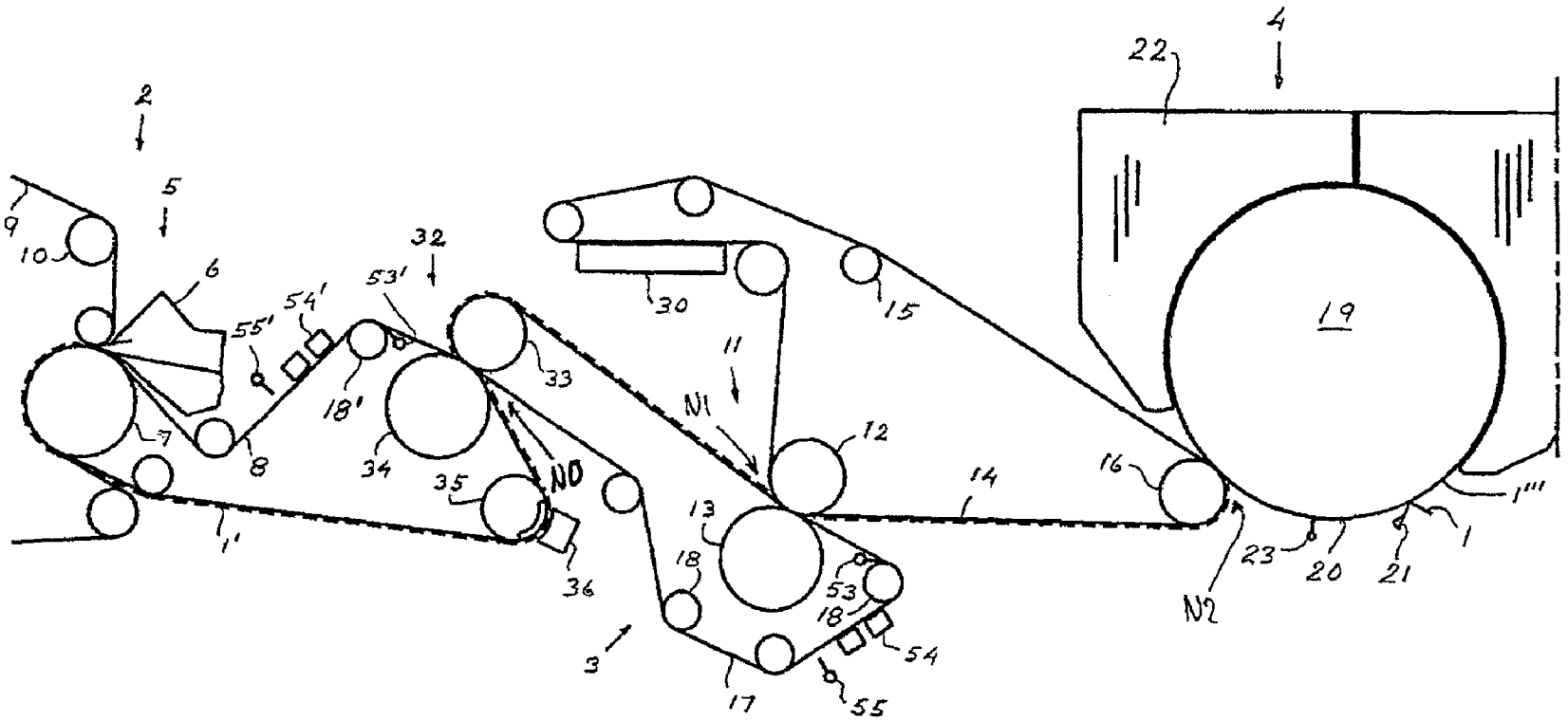

In the embodiment according to FIG. 5 (which, along with the embodiments of FIGS. 6-10, are suitable for re-builds of existing multi-press conventional machines), the first inner forming clothing 8, the press felt 17, and the structuring belt 14 have their own loops, wherein the forming clothing 8 is a felt running about a plurality of rolls 18'. The press section 3 in this case comprises a pre-press 32 including a first press element 33 located within the loop of the press felt 17 and a second press element 34 located within the loop of the first inner forming clothing 8, the press elements 33, 34 forming a press nip N0 therebetween through which the forming clothing 8 carrying the fibrous web 1' runs in order to meet the press felt 17 which also runs through the press nip N0 in order to receive the formed fibrous web 1' and carry it on to the main press 11. The forming clothing 8 thus also forms the second press felt of the pre-press 32. The supporting roll located immediately upstream of the second press element 34 is a suction roll 35 by means of which water is removed from the forming clothing 8. A steam box 36 is located on the outside of the forming clothing 8 immediately in front of or opposite to the suction roll 35 in order to enhance dewatering of the clothing 8. Immediately in front of the first roll 18' after the pre-press 32, a spray device 53' is arranged on the inside of the forming clothing 8 for supplying clarified white water into the wedge-shaped tapering space between the forming clothing 8 and the roll 18', the water being pressed into the forming clothing 8 and displacing the contaminated water in the forming clothing 8 after pressing in the pre-press 32 through and out of the forming clothing 8 when this runs about the roll 18'. Upstream of the following roll 18', suction boxes 54' (or similar devices) are arranged on the outside of the forming clothing 8 in order to withdraw and remove water from clothing 8 serving as the press felt 8, and a high-pressure water spray device 55' is arranged to clean the forming clothing 8 before it reaches the forming roll 7.

Figure 6:
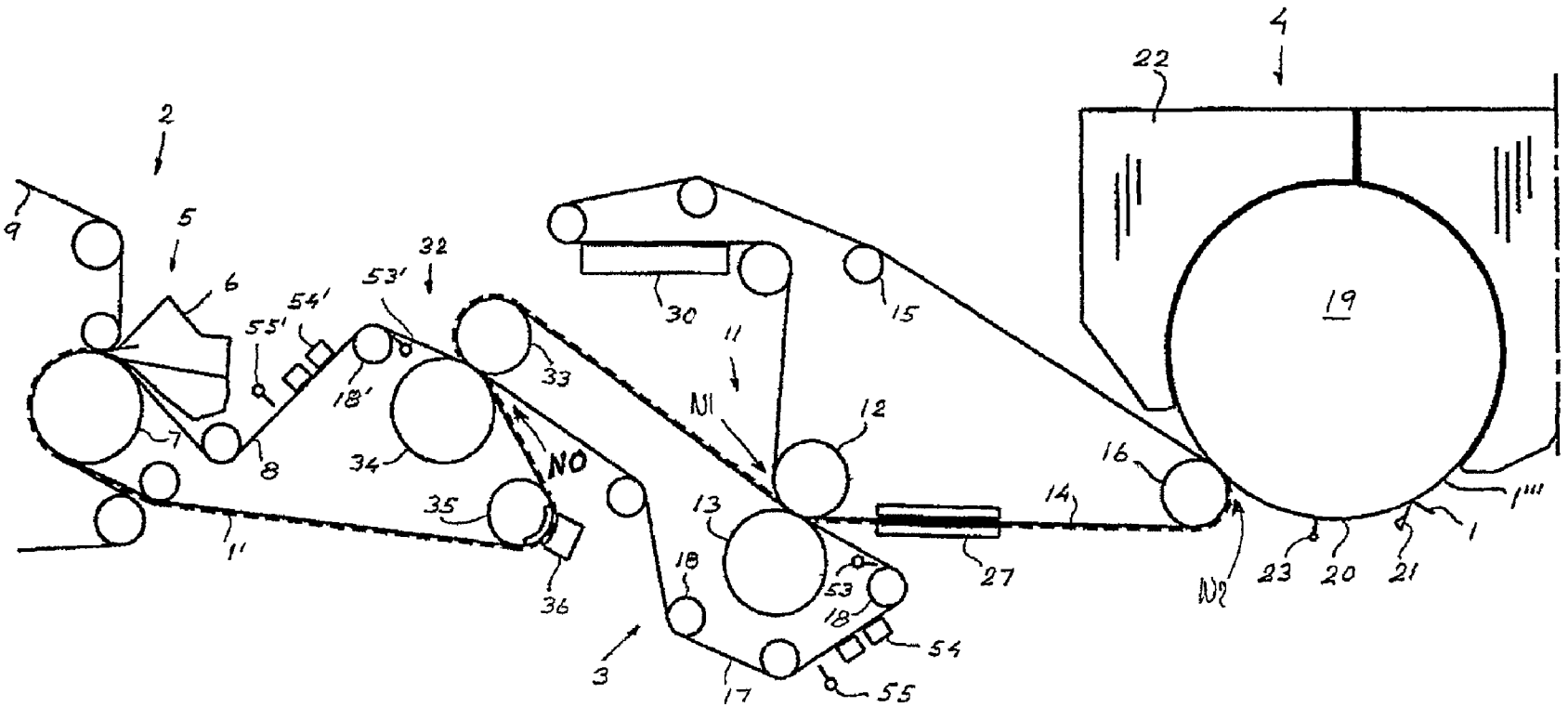

The embodiment according to FIG. 6 is similar to that of FIG. 5, except that it further includes a preheating device 27 corresponding to the embodiment of FIG. 2.

In the embodiment according to FIG. 7, the first inner forming clothing 8, that is a forming fabric, the press felt 17, and the structuring belt 14 having the structuring layer 60 have their own loops as in the embodiment according to FIG. 5. In this case, the forming section 5 is thus a twin-wire C-former. The forming roll 7 may be a suction roll if desired. The press section 3 in this case also comprises a pre-press 32 including a first press element 33 located within the loop of the press felt 17 and a second press element 34 located within a second press felt 37 running in a loop about a plurality of support rolls 38, wherein the support roll located immediately upstream of the second press element 34 is a suction roll 39 by means of which water is removed from the second press felt 37. A steam box 50 is located on the outside of the second press felt 37 immediately in front of or opposite to the suction roll 39 in order to improve dewatering of the press felt 37. The second press felt 37 runs in contact with the first inner forming fabric 8 in order to form a transfer zone in which the press felt 37, the formed fibrous web 1' and the forming fabric 8 form a sandwich structure. When the fibrous web 1' leaves the transfer zone, it is carried by the second press felt 37. A suction device 51 may be located within the loop of the second press felt 37 after the transfer zone in order to ensure the transfer of the fibrous web 1'. Immediately in front of the first support roll 38 after the pre-press 32, a spray device 53' is arranged on the inside of the press felt 37 for supplying clarified white water into the wedge-shaped tapering space between the press felt 37 and the support roll 38, the water being pressed into the press felt 37 and displacing the contaminated water in the press felt 37 after pressing in the pre-press 32 through and out of the press felt 37 when this runs about the support roll 38. Upstream of the following support roll 38, suction boxes 54' are arranged on the outside of the press felt 37 in order to withdraw and remove water from the press felt 37, and a high-pressure water spray device 55' is arranged to clean the press felt 37 before it reaches the suction device 51.

The embodiment according to FIG. 8 is similar to that of FIG. 7, except that it further includes a preheating device 27 after the main press corresponding to the embodiment of FIG. 2 in order to increase the temperature and dryness of the wet paper web 1".

The embodiment according to FIG. 9 is similar to that of FIG. 7 except that the wet section 2 in this case has a forming section 5 of a type other than C-former and Crescent former as mentioned previously. The forming section according to FIG. 9 is a so-called suction breast roll former including a headbox 6, a forming roll 7 (a so-called suction breast roll) and a forming clothing 8 running in a loop about the suction breast roll 7 and supporting rolls 18 and forming a transfer zone with the second press felt 37 generally as in the embodiment according to FIG. 7. The suction breast roll 7 has a suction zone 52 forming a forming zone across which the forming fabric 8 passes together with stock emitted from the headbox 6 and dewatered within the forming zone 52 in order to form a formed embryonic fibrous web 1'.

The embodiment according to FIG. 10 is similar to that of FIG. 9, except that it further includes a preheating device 27 corresponding to the embodiment of FIG. 2.

The pre-press 32 used in the embodiments according to FIGS. 5-10 may be a press selected from the group of different presses described above in connection with the main press 11.

As illustrated in FIG. 11, the structuring belt 14 comprises a structuring layer 60 forming the side of the structuring belt 14 that contacts and carries the fiber web. The layer 60 has a web-contacting surface 61 having a three-dimensional (3D) structure formed by depressions 63 in the otherwise flat web-contacting surface 61, the depressions 63 being regularly recurrent and distributed in the longitudinal direction (MD) and cross direction (CD) of the structuring belt 14. The web-contacting surface 61 thus has a flat, continuous top surface area 70 in which the depressions 63 in the form of recesses or depressions are defined. Each depression 63 in the web-contacting surface 61 is thus delimited by the continuous top surface area 70. In addition to these depressions 63, further patterns in the form of figures or logos may be formed in the structuring layer 60.

All of the depressions can be identical if desired. Alternatively, the depressions can comprise two or more groups of depressions, wherein the design of the depressions in the different groups differs, but the depressions within each group are identical.

Tests have shown that the form, extent, and volume of the depressions 63 are very important with respect to the runnability of the tissuemaking machine (and particularly with respect to the ability of the fibrous web to separate from the structuring layer 60 under the influence of hydraulic pressure communicated into the depressions) as well as its ability to produce a tissue paper web of good quality, i.e., having high bulk of 8-20 $cm^3/g$ and high softness, at a lower energy consumption compared to corresponding conventional or TAD-machines having comparable dimensions. Alternatively the process/structuring layer of the invention can allow decreasing the required drying capacity/energy supply (e.g., decreased drying section/machine dimensions or fewer fans for the hood/air supply) while keeping the same dimensions and speed as those of conventional or TAD-machines, or can allow increasing the machine speed (higher production) at the same energy consumption and the same dimensions as those of conventional or TAD-machines.

In order to achieve an optimum structure and dryness of the web, it is important that the structuring belt 14 allows the wet fibrous web 1' to be formed into the depressions 63 when the fibrous web 1' passes through the press nip N1 sandwiched between the press felt 17 and the structuring belt 14. It is also important that the press felt 17 can reach down into the depressions 63 during the pressing process in order to build up a sufficiently high hydraulic pressure so that water in the wet fibrous web 1' can move into the press felt 17 and not remain in the fibrous web at the end of the pressing operation. The depressions 63 must be sufficiently large to allow the press felt 17 to penetrate into the depressions 63 together with the fibrous web. Each depression 63 must have an optimum depth that allows water in the bottom of the depression 63 to be transported away. In other words, the depth of the depression 63 must not be too great, as an excessive depth will prevent the desired hydraulic pressure from building up and thus will not facilitate the release of the web after leaving the press nip.

The structuring layer 60 with this specific well-defined, structured, web-contacting surface 61 is an important parameter for controlling the structure, thickness/bulk, and dryness of the structured and partially dewatered fibrous web 1" after the press nip N1 before final drying.

The pressure in the press nip N1 should not be excessively high but rather should be within the normal ranges conventionally used for pressing, and the press felt 17 can be of the conventional elastically compressible type, which, in addition to its required water-receiving capacity during compression, is able to be elastically deformed into the web-contacting surface of the structuring layer 60 with the wet fibrous web 1' located therebetween in the manner as described above for co-acting with the depressions 63 so as to create the hydraulic pressure therein.

Each depression 63 has a predetermined dimension l in the machine direction (MD) of the structuring layer 60 and a predetermined dimension b in the cross direction (CD) of the belt 14. The depressions 63 may be oriented in the machine direction, in which case $l>b$, or in the cross direction, in which case $l<b$. However, the depressions 63 are preferably oriented substantially in the machine direction, as this gives better and more-uniform creping and results in a softer tissue paper.

Each depression 63 also has a predetermined depth d, a predetermined area a, and a predetermined volume v. The depth d of each depression may be constant over substantially all of the depression 63, in which case the depression 63 has a bottom surface 71 that is flat and parallel to the top surface area 70. The depth d alternatively may vary over the surface of the depression 63, in which case the depth d represents an average or mean depth over the surface of the depression.

The depressions 63 are arranged at a predetermined distance from each other so that they are distributed in a uniform manner over the web-contacting surface 61 and cover a predetermined part thereof. Thus, the abovementioned continuous top surface area 70 constitutes the remaining part of the web-contacting surface 61 and delimits the depressions 63, and constitutes the part of the web-contacting surface 61 cooperating with the drying surface 20 when the fibrous web 1" is transferred to the drying cylinder 19.

The above-mentioned parameters must therefore cooperate in order to obtain good runnability (such as no web breaks) and good quality of the tissue paper web 1'''. Tests have shown that the following parameters should exist in order to achieve this:

| l [mm] | b [mm] | d [mm] | a [$mm^2$] | v [$mm^3$] |
|---|---|---|---|---|
| 0.25-2.5 | 0.25-2.0 | 0.05-0.6 | 0.063-5.0 | 0.05-1.0 |

In the case where the depth of the depression 63 varies between being in the non-compressed state and in the compressed state in the nip depending on the material used, the value d refers to the mean depth of the depression. However, under no circumstances should the greatest depth value d of the depression exceed 0.6 mm, as measured when the structuring layer 60 of the structuring belt 14 is under compression in a press nip.

In addition to the abovementioned parameter values, the depressions preferably should collectively cover between about 20% and about 80% of the total web-contacting surface 61.

A tissue paper web (preferably creped) having the following properties on the reel can be manufactured in a tissue papermaking machine provided with a structuring belt with a structuring layer as above:

| | |
|---|---|
| Basis weight | 10-50 g/$m^2$ |
| Thickness | 160-400 μm, preferably 200-300 μm |
| Bulk | 8-20 $cm^3$/g |
| MD tensile strength | 50-300 N/m |
| CD tensile strength | 30-250 N/m and |
| Softness | 70-90 at a scale from 0 to 100, |

while the conventional creped tissue paper web has a bulk of 6-9 $cm^3$/g and softness of 50-70 measured according to EMTEC TSA (Tissue Softness Analyzer with a scale from 0 to 100) for conditioned paper at 20° C. and 50% air humidity.

More specifically, tissue paper of a quality suitable for facial tissue, toilet paper, and household paper can be manufactured by a tissue papermaking machine according to the invention, the tissue paper having the following properties:

| | Facial | Toilet paper | Household paper |
|---|---|---|---|
| Basis weight (g/$m^3$) | 13-15 | 15-25 | 18-23 |
| Bulk ($cm^3$/g) | 10-13 | 10-15 | 10-14 |
| MD tensile strength (N/m) | 70-120 | 50-150 | 170-300 |
| CD tensile strength (N/m) | 50-100 | 30-100 | 170-300 |

Figure 12:
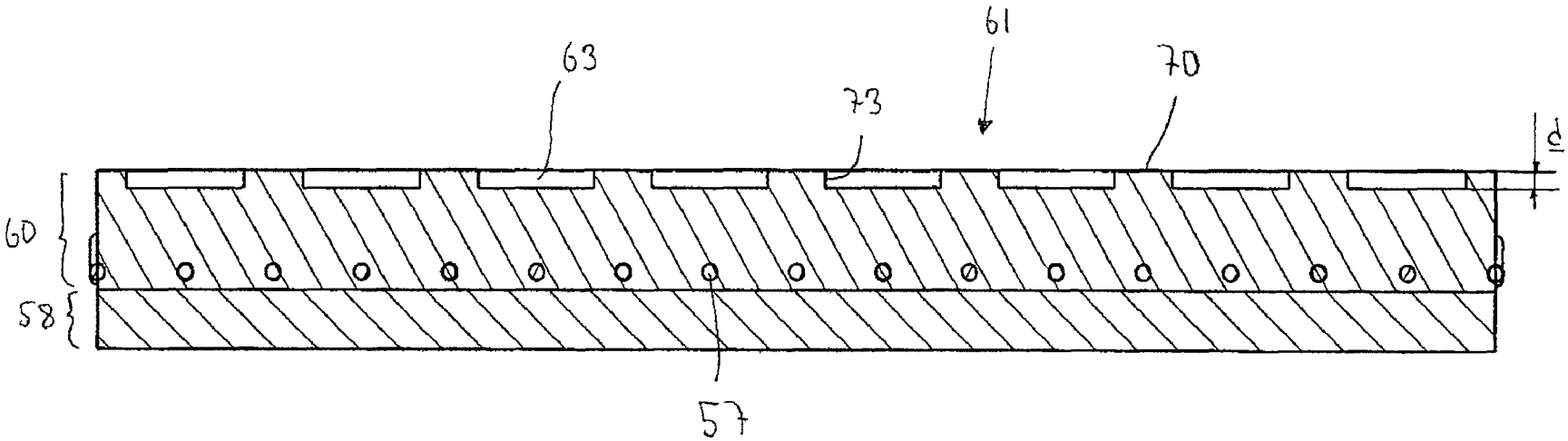

FIG. 11 shows a first embodiment of a structuring belt 14 with a structuring layer 60, a reinforcing layer 57, and a wear layer 58. FIG. 12 is a partial view of this belt 14 in a cross section in the machine direction (MD). The web-contacting surface 61 of the forming layer 60 has a plurality of identical depressions 63 arranged in parallel rows 72 extending in the machine direction of the belt 14. Adjacent rows 72 are displaced by approximately half the length of a depression relative to each other in the machine direction. Each depression 63 is substantially in the form of a recess whose shape (as viewed in the z-direction) is substantially a square block with cylindrical ends, which may alternatively be described as an oval shape. The square blocks or ovals extend in the machine direction of the belt 14. The bottom surface 71 of each depression 63 is flat and parallel to the continuous top surface area 70 (although such flat/parallel configuration is not a necessity, but is a result of the laser engraving technique used to form the depressions) in this case. If there is an underlying reinforcing structure beneath the structuring layer 60, the depth d of the depression does not reach the reinforcing structure. Thus, the depressions 63 are entirely formed within the thickness of the structuring layer 60. The side walls 73 of the depression 63 form a substantially 90° angle relative to the bottom surface 71 of the depression (which again is not a necessity, and this could vary depending on the manufacturing technique employed). The depressions 63 have a dimension l in the machine direction of 2.0 mm and a dimension b in the cross direction of 1.0 mm. The depth d is 0.3 mm. The depressions 63 have an area a of 0.3-4.0 $mm^2$, more preferably 0.5-2.0 $mm^2$, for example 1.8 $mm^2$, and a volume v of approximately 0.05-1.0 $mm^3$, preferably 0.536 $mm^3$. The distance s between two adjacent depressions 63 in the machine direction is approximately 1.0 mm. The distance t between two adjacent rows 72 of depressions 63 in the cross direction is approximately 0.5 mm. The depressions 63 cover approximately 20-80% of the web-contacting surface 61, preferably 40% of the web-contacting surface.

Figure 13:
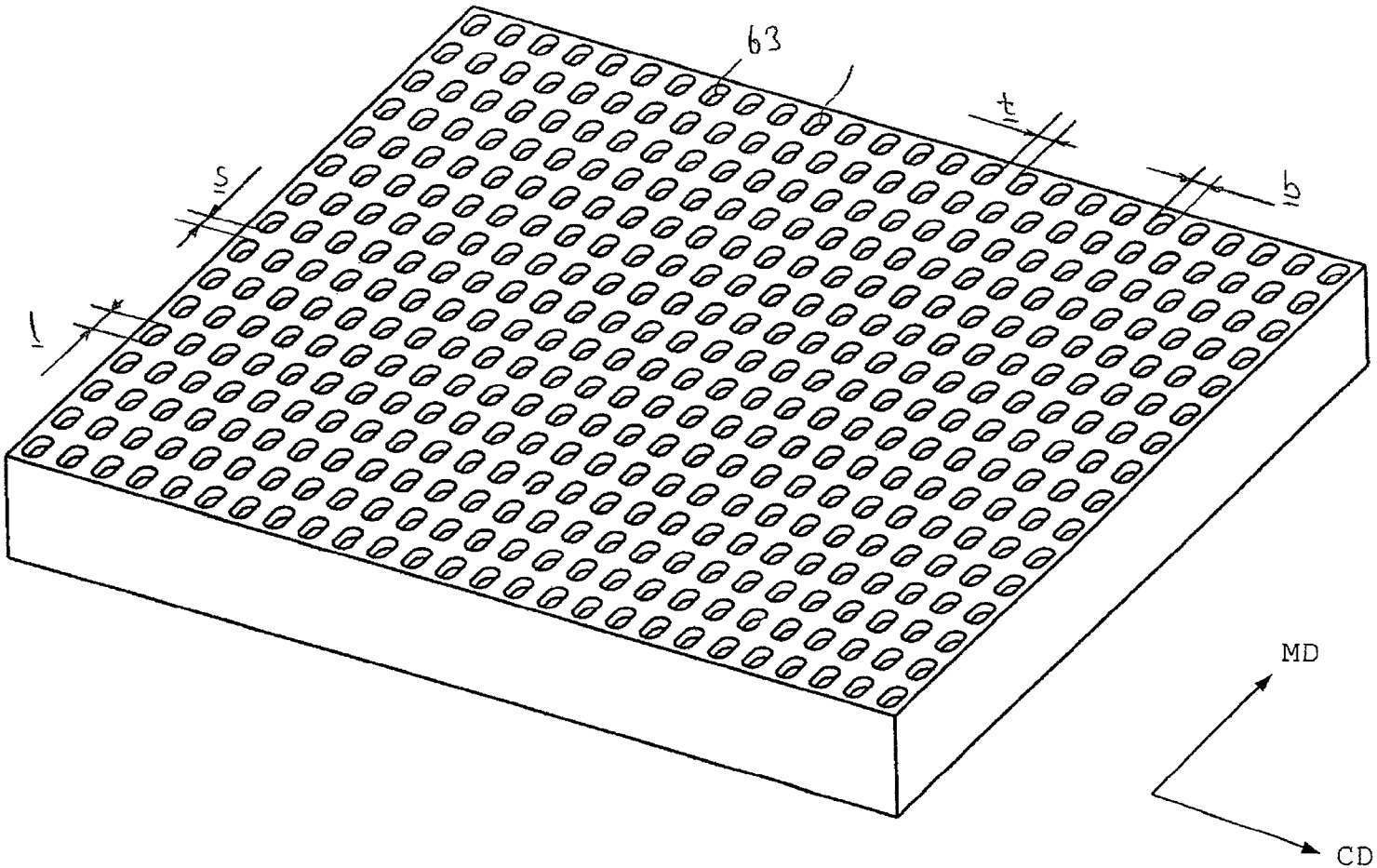
FIG. 13 shows a structuring layer of a structuring belt according to a second embodiment of the invention.

FIG. 13 shows a second embodiment of a structuring belt 14 according to the invention. In this embodiment, the structuring belt 14 consists solely of a structuring layer 60. The structuring layer 60 of the belt 14 has depressions 63 of substantially the same form and arranged in the same manner as the depressions 63 described above. In this case, the depressions 63 have a dimension l in the machine direction of 1.0 mm, a dimension b in the cross direction of 0.5 mm, a depth d of 0.2 mm, an area a of approximately 0.3-4.0 $mm^2$, preferably of 0.45-0.5 $mm^2$, and a volume v of approximately 0.089 $mm^3$. The distance s between two adjacent depressions 63 in the machine direction is 0.5 mm. The distance t between two adjacent rows 72 of depressions 63 in the cross direction is 0.5 mm.

Figure 14:
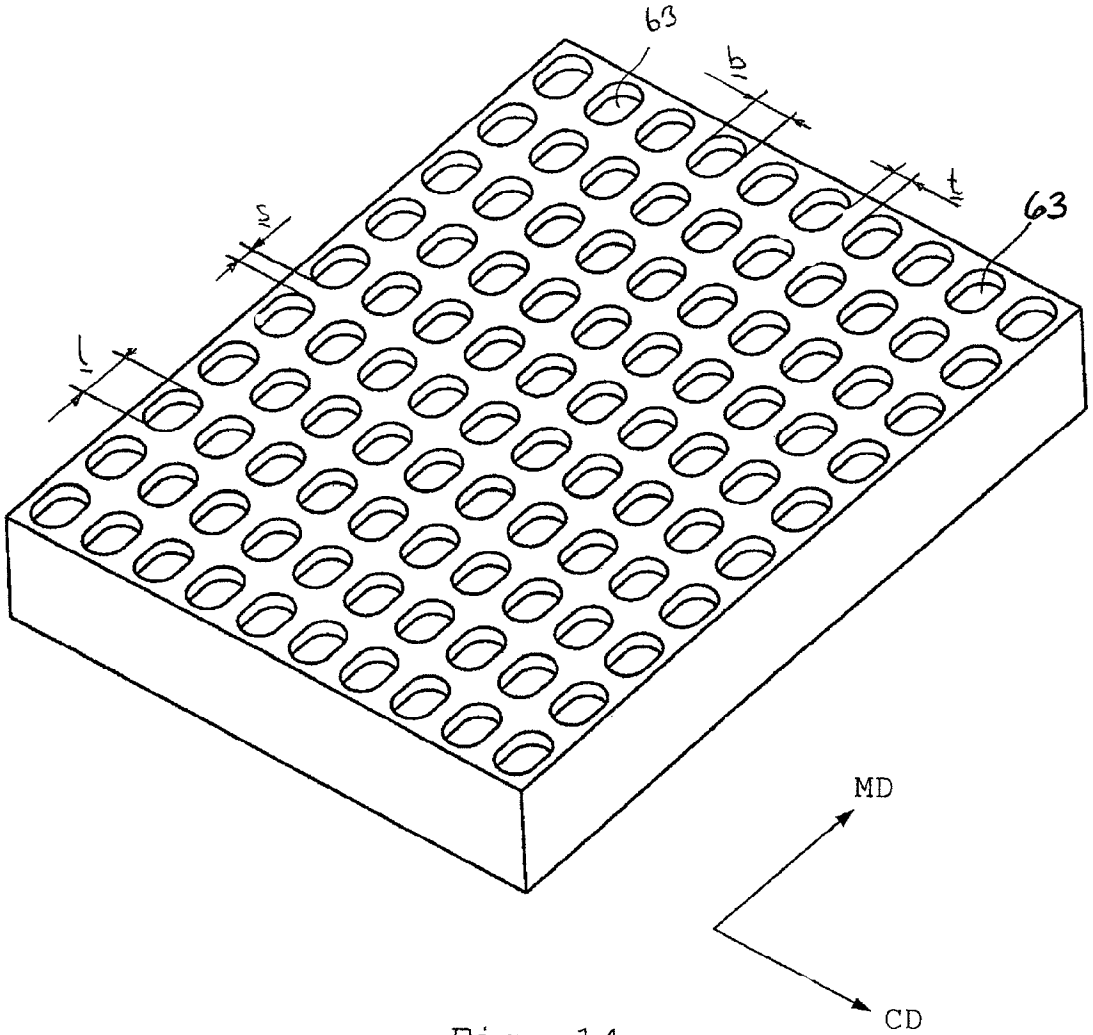
FIG. 14 shows a structuring layer of a structuring belt according to a third embodiment of the invention which has another ratio between depressions and land area.

FIG. 14 shows a third embodiment of a layered structuring belt 14 according to the invention, said structuring layer of the belt 14 also having the depressions 63 of substantially the same form and arranged in the same manner as the depressions described in connection with FIG. 11. In this case, the depressions 63 are slightly larger than the depressions shown in FIG. 13 and have a dimension l in the machine direction of 0.5 mm, a dimension b in the cross direction of 1.0 mm, a depth d of 0.4 mm, and a volume v of approximately 0.514 $mm^3$. The distance s between two adjacent depressions 63 in the machine direction is 0.5 mm. The distance t between two adjacent rows 72 of depressions 63 in the cross direction is 0.5 mm.

Figure 15:
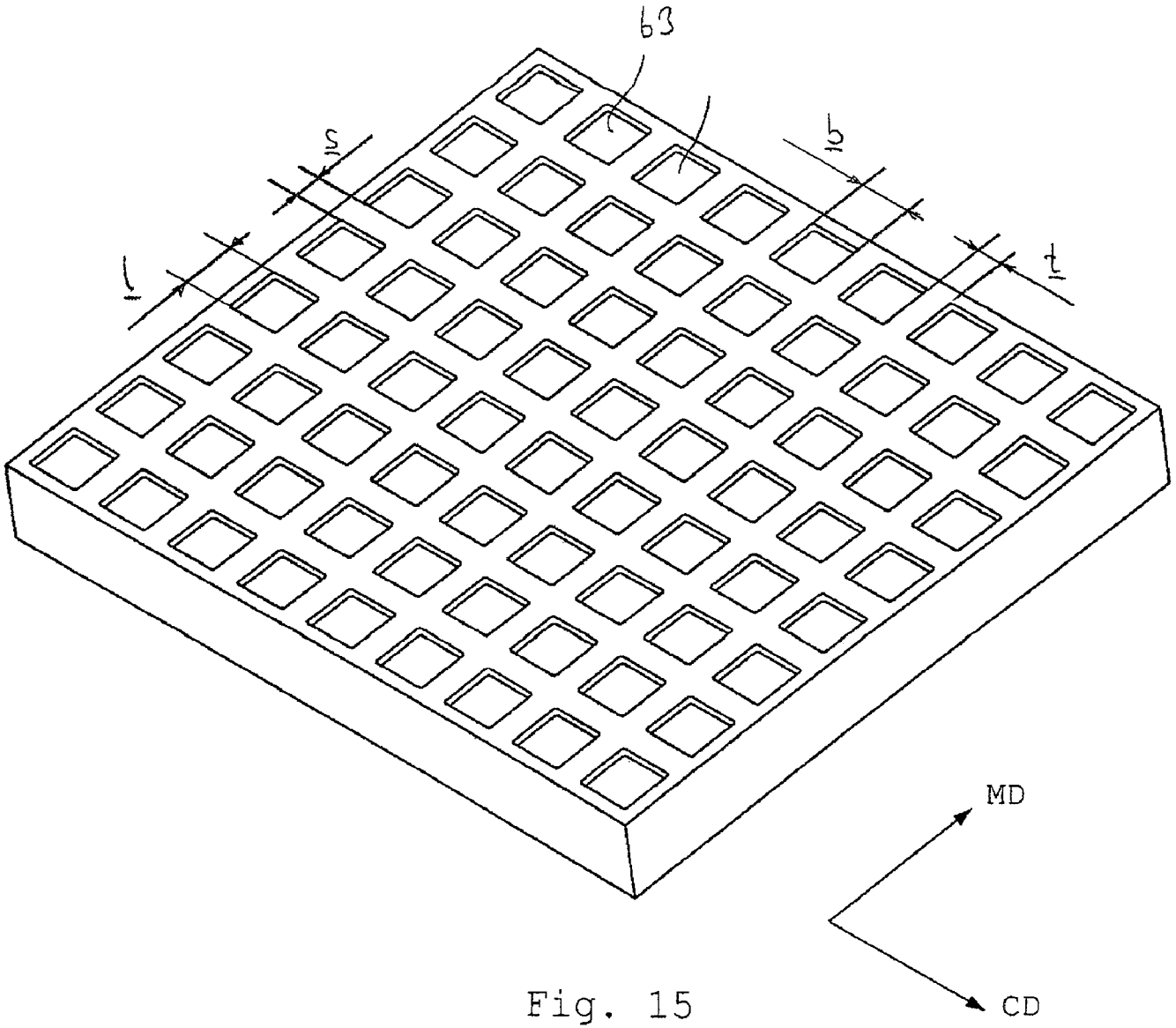
FIG. 15 shows a structuring layer with another pattern of a structuring belt according to a fourth embodiment of the invention.

FIG. 15 shows a further embodiment of a structuring belt 14 according to the invention. In this case, the depressions 63 are formed by recesses or depressions, which, except for rounded inner corners, are substantially entirely rectangular or formed as square blocks. The depressions 63 are arranged in rows 72 extending in the machine direction of the belt 14 and columns 74 extending in the cross direction of the belt 14. In this embodiment, the depressions 63 have a dimension l in the machine direction of 2.0 mm, an extent b in the cross direction of 2.0 mm, a depth d of 0.2 mm, an area of approximately 3.9 $mm^2$, and a volume v of approximately 0.79 $mm^3$. The distance s between two adjacent depressions 63 in the machine direction is 1.0 mm. The distance t between two adjacent rows 72 of depressions 63 in the cross direction is 1.0 mm.

Figure 16:
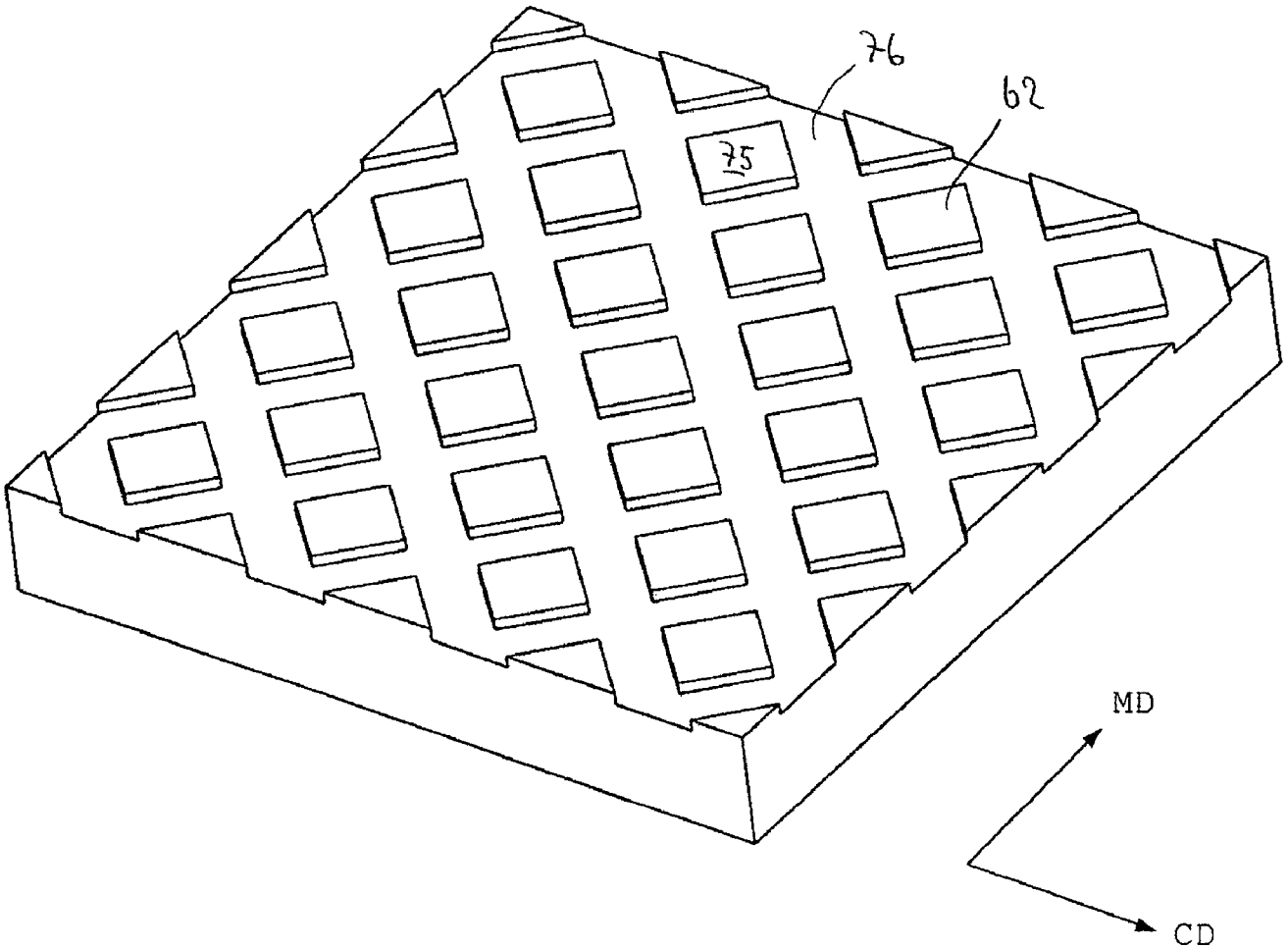
FIG. 16 shows a structuring layer with another pattern of a structuring belt according to a fifth embodiment of the invention.

FIG. 16 shows an alternative embodiment of a structuring belt 14, in which the belt 14 instead of recesses is provided with elevations 62 in the form of projecting portions or "islands" in the otherwise flat, continuous surface area 76. The same parameter values specified above in the case of the belts 14 with recesses also apply to this variant of the structuring belts, with the difference that the value d in this case gives the height of the elevations. In the embodiment shown in FIG. 16, the elevations 62 are in the form of square blocks projecting 0.2 mm from the surface area 76. The square blocks are 1 mm long and 1 mm wide and are arranged in rows extending diagonally in the machine direction of the structuring belt 14. The elevations consequently have a dimension l in the machine direction and a dimension b in the cross direction of approximately 1.4 mm in each case. Each elevation 62 has an area a of approximately 1.9 $mm^2$ and a volume v of approximately 0.8 $mm^3$. The elevations 62 cover approximately 35% of the web-contacting surface 61. The upper surface areas 75 of the elevations 62 are preferably flat so that they cooperate with the drying surface 20 when the fibrous web 1" is transferred to the drying cylinder 19.

The structuring layer 60 is preferably made of a polymer material, e.g., polyurethane, in which layer 60 the depressions 63 preferably are formed by laser burning. The structuring layer 60 may alternatively be made of a different material, e.g., metal or carbon fiber, and other techniques may be used to form the depressions. The structuring layer 60 is preferably approximately 3-6 mm thick, but its thickness may be between 0.2 and 10 mm. The structuring layer 60 may be provided with a reinforcing member 57 and a wear layer 58.

The structuring belt 14 with the layer 60 is preferably substantially water-impermeable as mentioned for the tissue papermaking machines shown in the drawings. Alternatively, the structuring belt 14 may be made permeable. This can help control of the adhesion of the web to the belt. For example, the structuring layer 60 may be needled so that it has through holes. The depressions or the surface area surrounding the depressions, or both, may be needled. Like the structuring layer 60, the wear layer 58 also can be needled if desired.

In order to increase the service life of the structuring belt 14, the structuring belt 14 may comprise a wear layer 58, e.g., in the form of a felt layer which is needled into the structuring layer 60 and arranged on the side of the structuring belt 14 directed away from the fibrous web.

In order to increase the strength of the structuring belt 14, the structuring belt 14 may comprise reinforcing means 57, e.g., in the form of reinforcement wires arranged within the structuring layer 60, a metal strip or a fabric.

With the aid of a structuring belt 14 according to the invention, it is thus possible to manufacture a tissue paper web which, after creping from the drying surface 20 and conditioning at 20° C. and an air humidity of 50%, has a basis weight in the range of 10-50 g/$m^2$, a thickness in the range of 160-400 μm, preferably 200-300 μm, a bulk in the range of 8-20 $cm^3$/g, an MD tensile strength in the range of 50-300 N/m, a CD tensile strength in the range of 30-250 N/m, and a softness in the range of 70-90 as measured according to EMTEC TSA (Tissue Softness Analyzer) with a measuring scale of 0 to 100.

Figure 17:
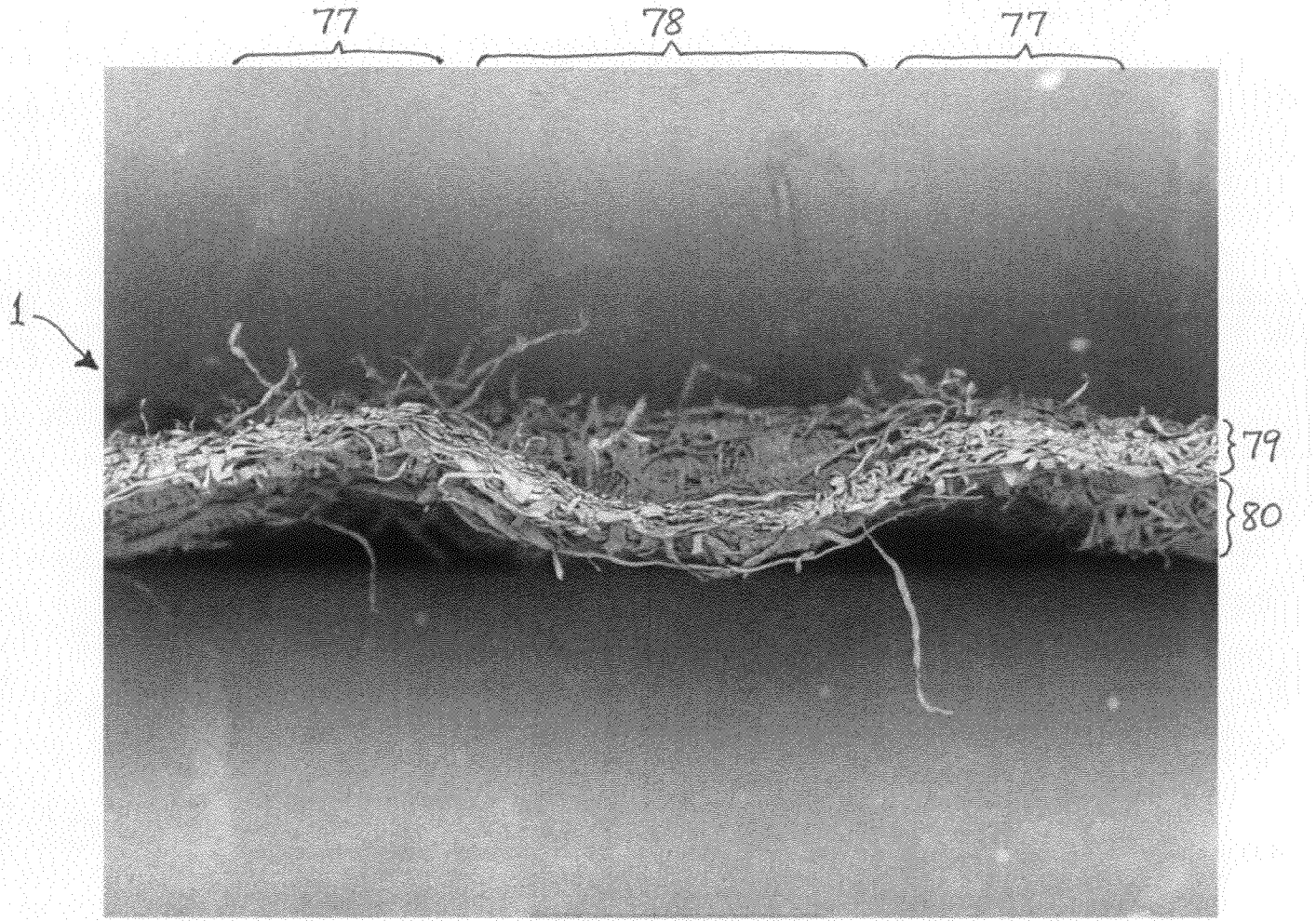
FIG. 17 shows a section of a tissue paper web manufactured by a tissue papermaking machine according to the invention.

FIG. 17 is a cross section through a tissue paper web 1 manufactured by a structuring belt including depressions 63 according to the invention. By virtue of the three-dimensional structure of the structuring layer 60, the finished tissue paper web 1 has a varying thickness, wherein the thickness of the tissue paper web 1 is smaller in those portions 77 in which the tissue paper web 1 has been formed by the top surface area 70 than in those portions 78 in which the tissue paper web 1 has been formed by the depressions 63 of the structuring belt 14.

Figure 18:
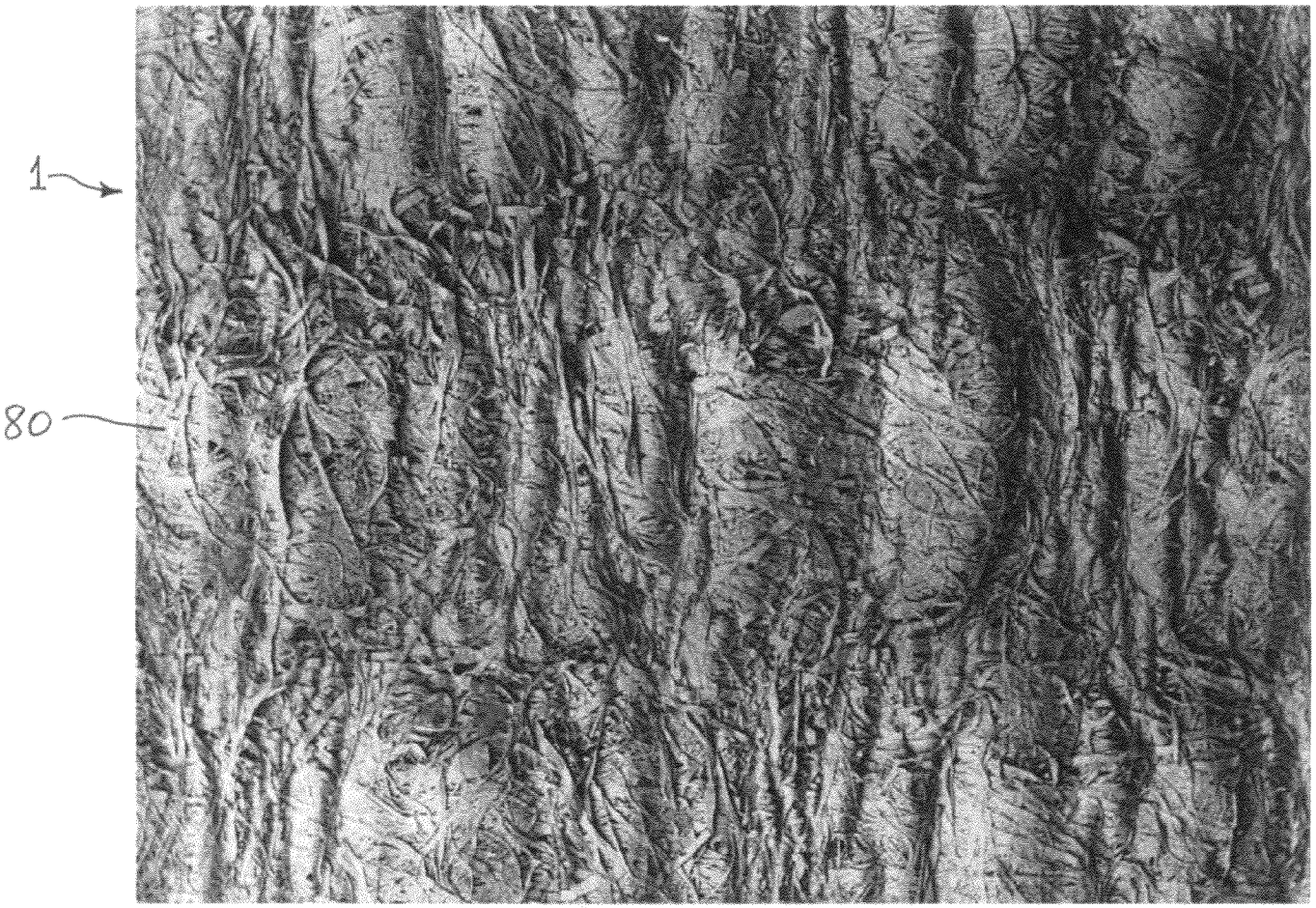
FIG. 18 shows an enlarged picture of the paper web consisting of fiber net structure.

The fibrous web 1', 1" preferably comprises a short-fiber layer and a long-fiber layer, wherein the fibrous web 1', 1" is transferred to the drying surface 20 in the transfer nip N2 with the short-fiber layer directed towards the drying surface 20. The finished tissue paper web 1 thus preferably also has a short-fiber layer on one side 79, i.e., the side which has been in contact with the drying surface 20, and a long-fiber layer on its other side 80, i.e., on the side which has been in contact with the structuring belt 14. FIG. 18 shows the long-fiber side 80 of the tissue fibre web 1.

The invention has been described above by way of a number of embodiments. However, it will be clear that other embodiments or variants are within the scope of the invention. For instance, it will be clear that alternative embodiments of the depressions are possible without going beyond the scope of the invention as defined in the claims. Alternative embodiments of this kind comprise, e.g. circular, rhombic or elliptical depressions, the longitudinal axes of which do not necessarily have to be situated in the machine or cross direction of the structuring belt, but may form an angle therewith.

What is claimed is:

1. A structuring layer of a structuring belt for structuring a wet fibrous web by means of pressing in a press section of a tissue papermaking machine for manufacturing a high bulk tissue paper web, said structuring layer being non-woven and having a web-carrying side defining a web-contacting surface for cooperating with the fibrous web, said web-contacting surface having depressions or elevations forming a three-dimensional structure of the web-contacting surface, wherein the depressions or elevations, respectively, are distributed over the web-contacting surface and collectively constitute about 20-80% of the area of the web-contacting surface, wherein when the web-contacting surface includes the depressions the web-contacting surface includes a flat continuous top surface area between the depressions and delimiting the depressions, wherein when the web-contacting surfaces includes the elevations the web-contacting surface includes a flat valley surface area between the elevations and delimiting the elevations, and wherein each depression or elevation, respectively, has a dimension l of 0.25-2.5 mm in a first direction in the plane of the top surface area or valley surface area, respectively, a dimension b of 0.25-2.0 mm in a second direction in the plane of the top surface area or valley surface area, respectively, said first and second directions being at right angles to each other, a mean depth or mean height d of 0.05-0.6 mm, and an area a as measured in the plane of the top surface area or valley surface area, respectively, of 0.063-5.0 $mm^2$, wherein the structuring layer is water-permeable, and the depressions or elevations are formed within the structuring layer.

2. The structuring layer according to claim 1, wherein the top surface area or valley surface area, respectively, is continuous.

3. The structuring layer according to claim 2, wherein each depression or elevation has an area a as measured in the plane of the top surface area or valley surface area, respectively, of 0.5-2.0 $mm^2$.

4. The structuring layer according to claim 2, wherein each depression or elevation has a volume v of 0.05-1.0 $mm^3$.

5. The structuring layer according to claim 2, wherein a plurality of the depressions or elevations in the web-contacting surface are identical.

6. The structuring layer according to claim 5, wherein the depressions or elevations are arranged in a regular pattern.

7. The structuring layer according to claim 6, wherein there are a plurality of groups of the depressions or elevations, the depressions or elevations of each group being identical to one another but different from the depressions or elevations of at least one other one of the groups.

8. The structuring layer according to claim 1, wherein the depressions or elevations are arranged in parallel rows extending in the machine direction (MD) of the structuring layer.

9. The structuring layer according to claim 1, wherein the dimension 1 of each depression or elevations extends in the machine direction (MD) of the structuring layer, the dimension b of each depression or elevations extends in the cross direction (CD) of the structuring layer, and 1>b.

10. The structuring layer according to claim 1, wherein the structuring layer is manufactured from one of polyurethane, carbon fiber, and metal.

11. A structuring belt for structuring a wet fibrous web in a press section by means of pressing in a tissue papermaking machine for manufacturing a high bulk tissue paper web, the structuring belt comprising: a structuring layer that is non-woven and that has a web-carrying side defining a web-contacting surface for cooperating with the fibrous web, said web-contacting surface having depressions or elevations forming a three-dimensional structure of the web-contacting surface, wherein the depressions or elevations, respectively, are distributed over the web-contacting surface and collectively constitute about 20-80% of the area of the web-contacting surface, wherein when the web-contacting surface includes the depressions the web-contacting surface includes a flat continuous top surface area between the depressions and delimiting the depressions, wherein when the web-contacting surfaces includes the elevations the web-contacting surface includes a flat valley surface area between the elevations and delimiting the elevations, and wherein each depression or elevation, respectively, has a dimension l of 0.25-2.5 mm in a first direction in the plane of the top surface area or valley surface area, respectively, a dimension b of 0.25-2.0 mm in a second direction in the plane of the top surface area or valley surface area, respectively, said first and second directions being at right angles to each other, a mean depth or mean height d of 0.05-0.6 mm, and an area a as measured in the plane of the top surface area or valley surface area, respectively, of 0.063-5.0 $mm^2$, wherein the structuring layer is water-permeable, and the depressions or elevations are formed within the structuring layer.

12. The structuring belt according to claim 11, wherein the structuring layer further comprises a wear layer arranged on the side of the structuring layer intended to be directed away from the fibrous web.

13. The structuring belt according to claim 12, wherein the structuring layer further comprises reinforcing means.

14. A press section for a tissue papermaking machine, the press section comprising: a main press including: a first press element, a second press element, said first and second press elements forming a press nip (N1) therebetween, a first clothing in the form of an elastically compressible press felt running in an endless loop about a plurality of support rolls and through the press nip (N1) together and in contact with the formed fibrous web, wherein the second press element is arranged within the loop of the press felt, a second clothing running in an endless loop about a plurality of support rolls and through the press nip (N1) together and in contact with the formed fibrous web, wherein the first press element is arranged within the loop of the second clothing, and a transfer roll for forming a transfer nip (N2) against a drying surface of a drying section following the press section, said transfer roll being arranged within the loop of the second clothing, wherein the second clothing comprises a structuring belt comprising a structuring layer that is non-woven and that has a web-carrying side defining a web-contacting surface for cooperating with the fibrous web, said web-contacting surface having depressions or elevations forming a three-dimensional structure of the web-contacting surface, wherein the depressions or elevations, respectively, are distributed over the web-contacting surface and collectively constitute about 20-80% of the area of the web-contacting surface, wherein when the web-contacting surface includes the depressions the web-contacting surface includes a flat continuous top surface area between the depressions and delimiting the depressions, wherein when the web-contacting surfaces includes the elevations the web-contacting surface includes a flat valley surface area between the elevations and delimiting the elevations, and wherein each depression or elevation, respectively, has a dimension l of 0.25-2.5 mm in a first direction in the plane of the top surface area or valley surface area, respectively, a dimension b of 0.25-2.0 mm in a second direction in the plane of the top surface area or valley surface area, respectively, said first and second directions being at right angles to each other, a mean depth or mean height d of 0.05-0.6 mm, and an area a as measured in the plane of the top surface area or valley surface area, respectively, of 0.063-5.0 $mm^2$, wherein the structuring layer is water-permeable.

15. The press section according to claim 14, wherein the press nip (N1) is an extended press nip.

16. The press section according to claim 15, wherein one of the press elements comprises a shoe press roll.

17. The press section according to claim 15, wherein one of the first and second press elements comprises an elastically deformable supporting element conformable to a surface of the other of the press elements during operation.

18. A tissue papermaking machine for manufacturing a structured high bulk tissue paper web by means of pressing, comprising: a wet section for forming a fibrous web; a drying section for final drying of the fibrous web, said drying section comprising a drying surface for drying the fibrous web; and a press section arranged between the wet section and the drying section, the press section comprising a main press including: a first press element; a second press element, said first and second press elements forming a press nip (N1) therebetween; a first clothing in the form of an elastically compressible press felt running in an endless loop about a plurality of support rolls and through the press nip (N1) together and in contact with the formed fibrous web, wherein the second press element is arranged within the loop of the press felt; a second clothing running in an endless loop about a plurality of support rolls and through the press nip (N1) together and in contact with the formed fibrous web, wherein the first press element is arranged within the loop of the second clothing; and a transfer roll for forming a transfer nip (N2) against the drying surface of the drying section, said transfer roll being arranged within the loop of the second clothing; wherein the second clothing comprises a structuring belt comprising a structuring layer that is non-woven and that has a web-carrying side defining a web-contacting surface for cooperating with the fibrous web, said web-contacting surface having depressions or elevations forming a three-dimensional structure of the web-contacting surface, wherein the depressions or elevations, respectively, are distributed over the web-contacting surface and collectively constitute about 20-80% of the area of the web-contacting surface, wherein when the web-contacting surface includes the depressions the web-contacting surface includes a flat continuous top surface area between the depressions and delimiting the depressions, wherein when the web-contacting surfaces includes the elevations the web-contacting surface includes a flat valley surface area between the elevations and delimiting the elevations, and wherein each depression or elevation, respectively, has a dimension l of 0.25-2.5 mm in a first direction in the plane of the top surface area or valley surface area, respectively, a dimension b of 0.25-2.0 mm in a second direction in the plane of the top surface area or valley surface area, respectively, said first and second directions being at right angles to each other, a mean depth or mean height d of 0.05-0.6 mm, and an area a as measured in the plane of the top surface area or valley surface area, respectively, of 0.063-5.0 $mm^2$, wherein the structuring layer is water-permeable.

19. The tissue papermaking machine according to claim 18, wherein the wet section comprises a headbox, a forming roll, a dewatering device, and a first forming clothing running about and in contact with the forming roll.

20. The tissue papermaking machine according to claim 19, wherein the dewatering device comprises a suction device arranged in the loop of the first forming clothing downstream of the forming roll, and a steam-applying device arranged on the outside of the loop of the first forming clothing in front of or opposite to the suction device.

21. The tissue papermaking machine according to claim 19, wherein the loop of the structuring belt extends between the main press and the transfer roll and the loop of the press felt of the main press extends between the forming roll and the main press, wherein the press felt of the main press also forms said first forming clothing.

22. The tissue papermaking machine according to claim 19, wherein the loop of the structuring belt extends between the forming roll and the transfer roll so as to also form said first forming clothing.

23. The tissue papermaking machine according to claim 18, wherein the drying surface is formed by the shell surface of a drying cylinder.

24. The tissue papermaking machine according to claim 18, wherein the drying surface is formed by one of a Yankee cylinder and a TAD cylinder wrapped by a TAD fabric.

25. The tissue papermaking machine according to claim 18, wherein the drying surface is formed by a metal belt.

26. The tissue papermaking machine according to claim 18, wherein the press section further comprises a pre-press including a first pre-press element and a second pre-press element, said pre-press elements forming a press nip (N0) therebetween, a press felt running in an endless loop about a plurality of support roils and through the press nip (N0) together with the press felt of the main press, wherein the second pre-press element is arranged within the loop of the press felt of the pre-press and the first pre-press element is arranged within the loop of the press felt of the main press, and wherein the formed fibrous web runs through the press nip (N0) of the pre-press sandwiched between the press felt of the main press and the press felt of the pre-press.

27. The tissue papermaking machine according to claim 26, wherein the structuring belt extends between the main press and the transfer roll, the press felt of the main press extends between the pre-press and the main press, and the first forming clothing extends between the forming roll and the pre-press and forms the press felt of the pre-press.

28. The tissue papermaking machine according to claim 26, wherein the structuring belt extends between the main press and the transfer roll, the press felt of the main press extends between the pre-press and the main press, the press felt of the pre-press extends between a transfer zone and the pre-press, and the loop of the first forming clothing extends between the forming roll and a support roll arranged in connection to said transfer zone.

29. The tissue papermaking machine according to claim 18, wherein at least one of the press nips (N1, N2) is an extended press nip.

30. The tissue papermaking machine according to claim 28, wherein the main press is a shoe press.

31. The tissue papermaking machine according to claim 18, wherein one of the first and second press elements comprises an elastically deformable supporting element conformable to a surface of the other of the press elements during operation.

* * * * *